US006758015B2

(12) United States Patent
Clasen et al.

(10) Patent No.: US 6,758,015 B2
(45) Date of Patent: Jul. 6, 2004

(54) MODULAR ROOF EQUIPMENT SCREENING ASSEMBLY

(76) Inventors: Daryl D. Clasen, 400 E. Capitol Dr., Hartland, WI (US) 53029; Jared Clasen, W249 N7934 Hillside Rd., Sussex, WI (US) 53089

( * ) Notice: Subject to any disclaimer, the term of this patent is extended or adjusted under 35 U.S.C. 154(b) by 0 days.

(21) Appl. No.: 10/106,434

(22) Filed: Mar. 26, 2002

(65) Prior Publication Data

US 2003/0182873 A1 Oct. 2, 2003

(51) Int. Cl.[7] ..... E04H 12/20; E04B 7/16

(52) U.S. Cl. ..... 52/73; 52/147; 52/146

(58) Field of Search ..... 52/764, 474, 73, 52/72, 146, 152, 147; 256/24, 25, 27; 248/906

(56) References Cited

U.S. PATENT DOCUMENTS

| | | | |
|---|---|---|---|
| 3,742,659 | A | 7/1973 | Drew |
| 3,806,622 | A | 4/1974 | Marchner |
| 3,817,006 | A | 6/1974 | Williams |
| 3,865,197 | A | 2/1975 | McCormick |
| 3,890,989 | A | 6/1975 | Kuxhouse et al. |
| D243,853 | S | 3/1977 | Ejchorszt |
| 4,016,691 | A | 4/1977 | Cale |
| 4,068,427 | A | 1/1978 | Camardo |
| 4,225,120 | A | 9/1980 | McLaughlin |
| 4,498,262 | A | 2/1985 | Garcia |
| 5,040,344 | A | 8/1991 | Durand |
| 5,228,262 | A | 7/1993 | Meriwether |
| 5,481,836 | A | 1/1996 | Miller et al. |
| 5,622,021 | A | 4/1997 | Bookout |
| 5,660,006 | A | 8/1997 | Emerson, Jr. |
| 5,664,384 | A | 9/1997 | Cullinan |
| 5,862,637 | A | 1/1999 | Bruce |
| 6,205,719 | B1 | 3/2001 | Bruce |

OTHER PUBLICATIONS

Printout of Envisor web site showing equipment screening design and photograph of Envisor equipment screening design. (Approximately 2001.)

Photographs of equipment screening installation by unknown installer. (Approximately 1993.)

Photograph of equipment screening installation mounted to roof by unknown installer. (Approximately late 1980's.)

*Primary Examiner*—Carl D. Friedman
*Assistant Examiner*—Kevin McDermott
(74) *Attorney, Agent, or Firm*—Andrus, Sceales, Starke & Sawall, LLP

(57) ABSTRACT

The present invention relates to a modular screening assembly for a piece of equipment on the roof of a building. The assembly includes two perpendicular sets of channels that are rigidly secured to and cantilevered from a base of the equipment. Each channel set has one or two sets of common ends. A vertically oriented framework formed by a number of frame sections is secured to the common ends. Each frame section is secured to one set of common ends and spaced a uniform distance from the equipment. Each frame section is formed by one or more like-shaped frame segments. Each frame segment holds one like-shaped panel. Two or more modular screening assemblies can be combined to form an integrated screening assembly around several pieces of equipment. Two or more tiers of framework and panels can be stacked vertically to attain a desired screening height.

22 Claims, 16 Drawing Sheets

MODULAR ROOF EQUIPMENT SCREENING ASSEMBLY

TECHNICAL FIELD OF THE INVENTION

This invention relates to a modular roof equipment screening assembly having a cantilevered support assembly that includes sets of channels secured to a base of one or more pieces of equipment, each set of channels extending in a different direction and supporting one section of an upwardly extending framework to provide uniform spacing between the framework and the equipment.

BACKGROUND OF THE INVENTION

Many conventional building designs locate ventilation, air conditioning and other equipment on the roof of the building. This equipment typically becomes dirty, rusted, and dented over time, which renders it unsightly in appearance. Many municipalities require roof equipment to be screened or otherwise aesthetically concealed from normal view, and a number of conventional roof equipment screening designs have been developed. Examples of existing screening designs are shown in U.S. Pat. Nos. 5,664,384 to Cullinan, 6,205,719 and 5,862,637 to Bruce, and Des. 243,853 to Eichorszt, the contents of which are incorporated by reference herein.

A problem with roof equipment screening design is supporting and anchoring the screening without penetrating the weatherproof layer of the roof. Several conventional designs are support or anchor the screening to the structural members beneath the weatherproof layer of the building. Some designs use mounting posts that pass through the weatherproof layer to make solid structural connections and support and anchor the screening. These penetrations through the weatherproof layer can create leaks in the roof that result in costly damage and are time consuming to repair.

Another problem with roof equipment screening design is that the screening can inhibit access to the equipment. This problem is particularly prevalent in top-down designs that secure the screening to the top of the equipment and allow it to hang down around the equipment. These screening systems are typically attached to and supported by the sheet metal housing around the equipment. This sheet metal is not typically robustly designed to readily handle the extra weight, wind and snow loads often associated with a screening system. Top-down designs typically spread the load around the top perimeter of the housing via a support frame and angle the screening down and away from the sides of the housing. Unfortunately, the physical presence of the frame and screening around the top of the housing can inhibit access to the equipment, such as when a maintenance person needs to service the equipment or quickly trouble shoot a problem with the equipment. The screening is often screwed, bolted, riveted or otherwise fastened to the housing in a manner that is time consuming to remove and replace. Working around the screening or removing and replacing the screening increases the time and difficulty of servicing or repairing the equipment. This is particularly troublesome on hot or cold days when the equipment needs to be running to maintain the air quality in the building. The screening is a nuisance to the maintenance personnel that have to work in the heat, cold, rain or wind to maintain and fix the equipment.

A further problem with roof equipment screening designs is that they should be readily adapted to fit a wide variety of equipment sizes and configurations. Equipment can vary a great deal in size and shape. One piece of equipment may be substantially longer, wider or taller than another pieces of equipment. Some pieces of equipment can also have irregular shapes or include components that jut out from the sides of its housing. As a result, many conventional screening systems need to be custom fit to a specific piece of equipment. The screening components are either custom made to fit a given piece of equipment, or extra cutting and forming work must be performed at the construction site. This customization increases the manufacturing and installation costs of the system.

A still further problem with roof equipment screening designs is that the design should accommodate taller pieces of equipment. Top-down screening systems have to extend down a significant distance to adequately screen a tall piece of equipment. This increases the load on the sheet metal housing of the equipment. The angle between the screening and the sides of the housing may be decreased to reduce the size and weight of the screening and framing. As a result, top-down designs may be inappropriate for some taller pieces of equipment. Other equipment screening designs only allow one row or tier of screening. The maximum height of the screening is the height of the tallest panel or section produced by the manufacturer.

A still further problem with roof equipment screening designs is that the screening assembly should be able to screen around multiple pieces of equipment. Buildings often locate several pieces of equipment relatively close together. Conventional top-down screening systems typically screen each piece of equipment separately no matter how close together they are located. These individual screening assemblies frequently interfere with each other and require custom fit installations that have an awkward appearance.

A still further problem with roof equipment screening designs is that the design should not need to be secured to all four sides of the equipment. An obstruction such as a building wall or another piece of equipment can prevent or render it undesirable to screen all four sides of the equipment. Yet, conventional screening systems can become unbalanced when they do not extend from all the sides of the equipment.

A still further problem with roof equipment screening design is that large portions or sections of screening should be easily removed to gain access to the equipment. Repairing and servicing equipment components can require a small portion of the screening to be removed. Repairing larger equipment components can require a larger portion or section of the screening and surrounding framework to be removed. The screening design should allow the maintenance person to remove whatever portion or section of the screening is adjacent to the place where the equipment is being repaired. Yet, many screening assemblies are limited to removing only large sections of screening and framework to gain access to a small part of the equipment. Even simple service jobs become time consuming and cumbersome projects.

A still further problem with roof equipment screening design is limiting the number of fasteners securing the screening assembly together and ensuring those fasteners are readily accessible. Problems arise when fasteners rust and become difficult to remove, or are located in awkward and difficult to reach places. Worker can have great difficulty removing a necessary amount of screening and framing to gain access to the equipment.

A still further problem with roof equipment screening design is creating an economical design that can handle the wind and snow loads placed on the system. Inexpensive designs tend to be structurally weak and can fail during strong winds or heavy snow loads. The frame and the panels can be bent, crushed or blown off. As a result, the components forming the screening system are in constant need of repair and replacement.

A still further problem with roof equipment screening design is that the components forming the system should be lightweight and easy to handle. Heavy, bulky or awkwardly shaped components can lead to work related injuries.

A still further problem with roof equipment screening designs is that the design should utilize weather resistant and low maintenance materials. Screening systems constructed of materials such as wood quickly show wear due to sun, wind, rain, snow and ice. Frequent repair and painting are needed to keep the screening looking good and aesthetically pleasing.

The present invention is intended to solve these and other problems.

BRIEF DESCRIPTION OF THE INVENTION

The present invention relates to a modular screening assembly for a piece of equipment on the roof of a building. The assembly includes two perpendicular sets of channels that are rigidly secured to and cantilevered from a base of the equipment. Each channel set has one or two sets of common ends. A vertically oriented framework formed by a number of frame sections is secured to the common ends. Each frame section is secured to one set of common ends and spaced a uniform distance from the equipment. Each frame section is formed by one or more like-shaped frame segments. Each frame segment holds one like-shaped panel. Two or more modular screening assemblies can be combined to form an integrated screening assembly around several pieces of equipment. Two or more tiers of framework and panels can be stacked vertically to attain a desired screening height.

An advantage of the present modular roof equipment screening assembly is that it does not penetrate the weatherproofing layer of the roof. The screening assembly is rigidly attached to and supported by the base of the roof equipment or the curb on which the equipment rests. The integrity of the weatherproofing layer is maintained, and costly and time consuming repairs caused by unnecessary leaks are avoided.

Another advantage of the present modular roof equipment screening assembly is its bottom-up construction. The assembly is supported by and anchored to the structurally robust base or curb of the equipment. The base and curb are designed to adequately support the weight of the equipment components, as well as any wind, snow or other loads the equipment may experience. The present screening assembly utilizes the strength of these components to support and anchor the screening assembly. A first set of support channels are secured directly to the base or curb. A second set of support channels are either secured directly to the base or curb, or directly to the first set of channels.

A further advantage of the present modular roof equipment screening assembly is that it allows easy access to the equipment. The four channels attach to the base of the equipment. These channels do not block access to the sides of the equipment housing. Each section of the vertically oriented framework is spaced a desired uniform distance from the housing. This creates a workspace that remains relatively constant along each side of the equipment, and creates a natural walkway or work area around the perimeter of the equipment. The vertically oriented framework helps maintain this uniform workspace or area through the height of the screening assembly. The screening assembly allows easy access to the equipment when maintenance personnel need to service or quickly trouble shoot a problem with the equipment.

A still further advantage of the present roof equipment screening assembly is that its modular design accommodates a wide variety of equipment sizes and shapes. The screening assembly accommodates equipment of significantly different lengths, widths, and heights. The screening assembly also accommodates irregularly shaped equipment or equipment with components that jut out from the sides of its housing. Custom manufacturing of components is avoided and installation costs are kept to a minimum.

A still further advantage of the present modular roof equipment screening assembly is vertically modular to accommodate taller pieces of equipment. The bottom-up construction allows the screening assembly to extend upwardly to a desired height to adequately screen taller pieces of equipment. The channels and framework are robustly designed to accommodate two or more tiers of framework and panels. A first tier is secured to the ends of the cantilevered support channels. A second tier is mounted to the top of the first tier. A third tier can be mounted to the top of the second tier. The height of the completed screening assembly is not limited to the height of a single frame segment, frame section or panel.

A still further advantage of the present modular roof equipment screening assembly is that it can be readily combined with other assemblies to screen two or more pieces of equipment located relatively close together. These pieces of equipment are efficiently screened by a single integrated screening assembly. The integrated screening assembly allows easy access to each of the pieces of equipment, particularly between the pieces of equipment because the screening assembly does not need to be squeezed between the pieces of equipment. The integrated screening assembly requires fewer components and less material than if each piece of equipment were screened separately. As a result, a more user friendly and economical screening system is achieved.

A still further advantage of the present roof equipment screening assembly is that it can screen fewer than all four sides of the equipment. One or more frame sections can be eliminated to accommodate a building wall or similar obstruction. The screening assembly remains structurally sound even when it does not completely surround or encircle the piece of equipment.

A still further advantage of the present modular roof equipment screening assembly is that the panels can be easily removed to gain access to the equipment. The modular nature of the screening assembly allows a maintenance person to remove just the panel or panels adjacent the part of the equipment being repaired. These panels are relatively large and easily removed while the frame remains completely intact. Only one readily accessible anti-rattle screw needs to be unfastened to remove each panel. Minimal time and effort are required to access and service the equipment.

A still further advantage of the present modular roof equipment screening assembly is that larger portions or sections can be easily removed to allow additional access to the equipment. The modular nature of the screening assembly allows a maintenance person to remove a frame segment or frame section adjacent the part of the equipment being repaired. One or more frame segments or an entire frame section can be relatively easily removed from the remainder of the framework by unfastening a minimal number of easily accessible bolts.

A still further advantage of the present roof equipment screening assembly is that it can handle significant wind and snow loads placed on the assembly as well as the weight of a person stepping on the channels or framework. The framework forms a truss structure to help accommodate these loads. The support assembly, framework and panels are robustly designed to resist bending and breaking due to normal wear and tear. Still, should a component part become damaged and need to be replaced, the modular design and use of like-shaped parts allows for easy and economical replacement of the damaged part. Order time and replacement costs are kept to a minimum.

A still further advantage of the present roof equipment screening assembly is that its component parts are lightweight and easy to handle. The framework has an all aluminum construction that greatly reduces the weight of the assembly. The component parts, frame segments and even the frame sections are relatively easy to handle, which maximizes construction efficiency and minimizes work related accidents and injuries.

A still further advantage of the present roof equipment screening assembly is that it utilizes weather resistant and low maintenance materials. The component parts are made of aluminum to resist wear and damage caused by rain, snow, ice and salt. The present assembly is designed to remain aesthetically pleasing without the need for frequent repairs and painting.

Other aspects and advantages of the invention will become apparent upon making reference to the specification, claims and drawings.

DESCRIPTION OF THE PREFERRED EMBODIMENTS

While this invention is susceptible of embodiment in many different forms, the drawings show and the specification describes in detail a few preferred embodiments of the invention. It should be understood that the drawings and specification are to be considered an exemplification of the principles of the invention. They are not intended to limit the broad aspects of the invention to the embodiments illustrated.

Figure 1:
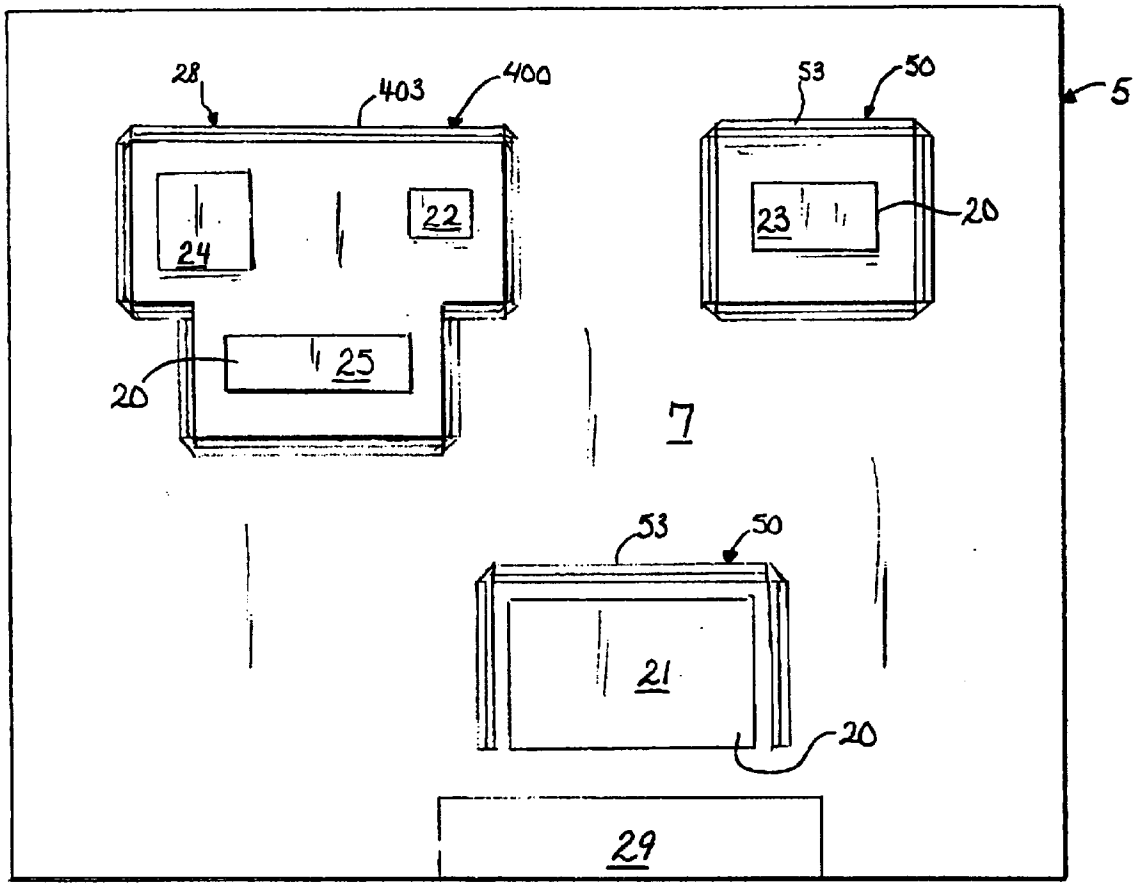
FIG. 1 is a top view showing several different pieces of equipment on the roof of a building.
Figure 2:
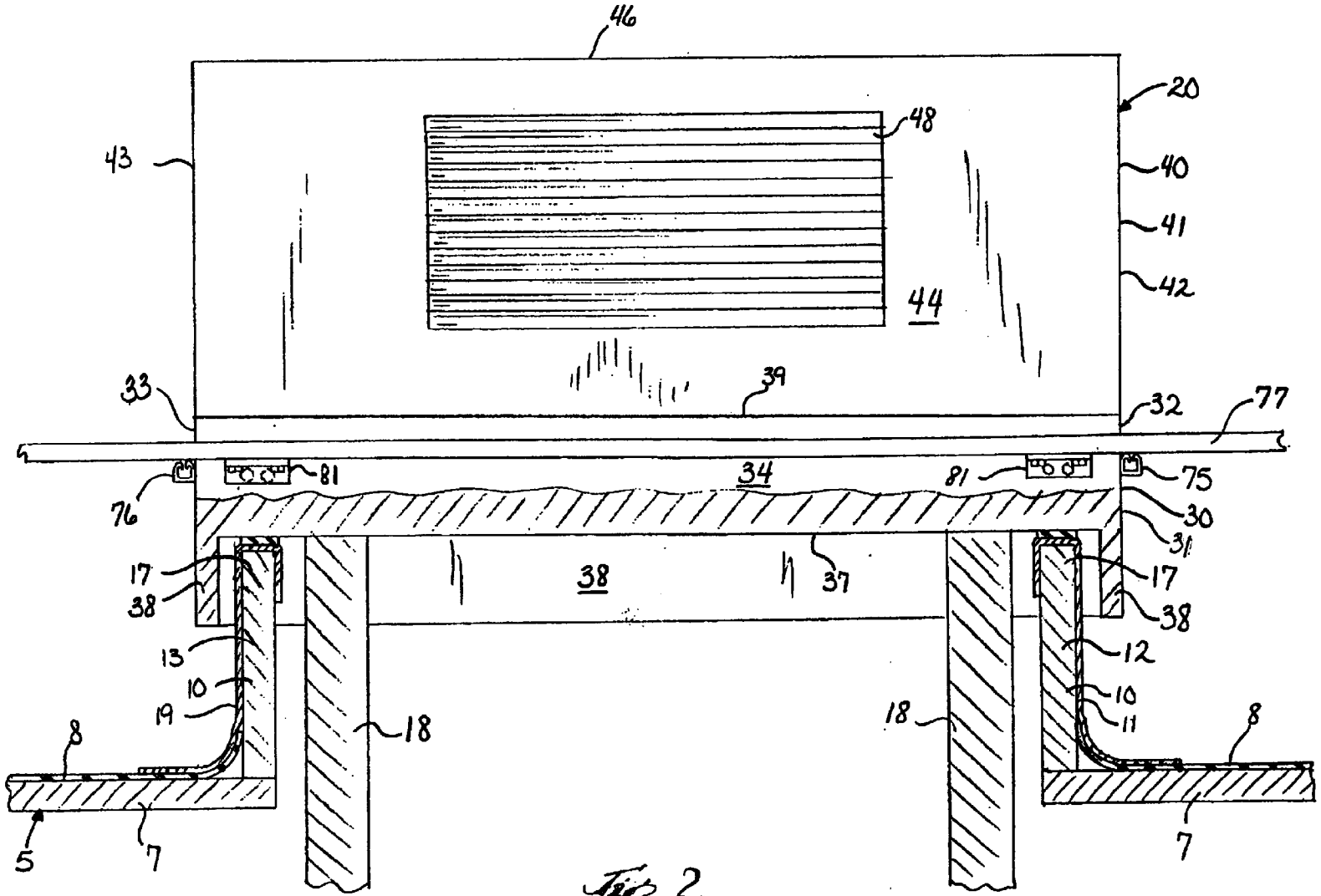
FIG. 2 is a cross-sectional view of the roof showing the weatherproof layer sealing against an equipment curb supporting a base of a piece of equipment, with each channel secured directly to the base.
Figure 2A:
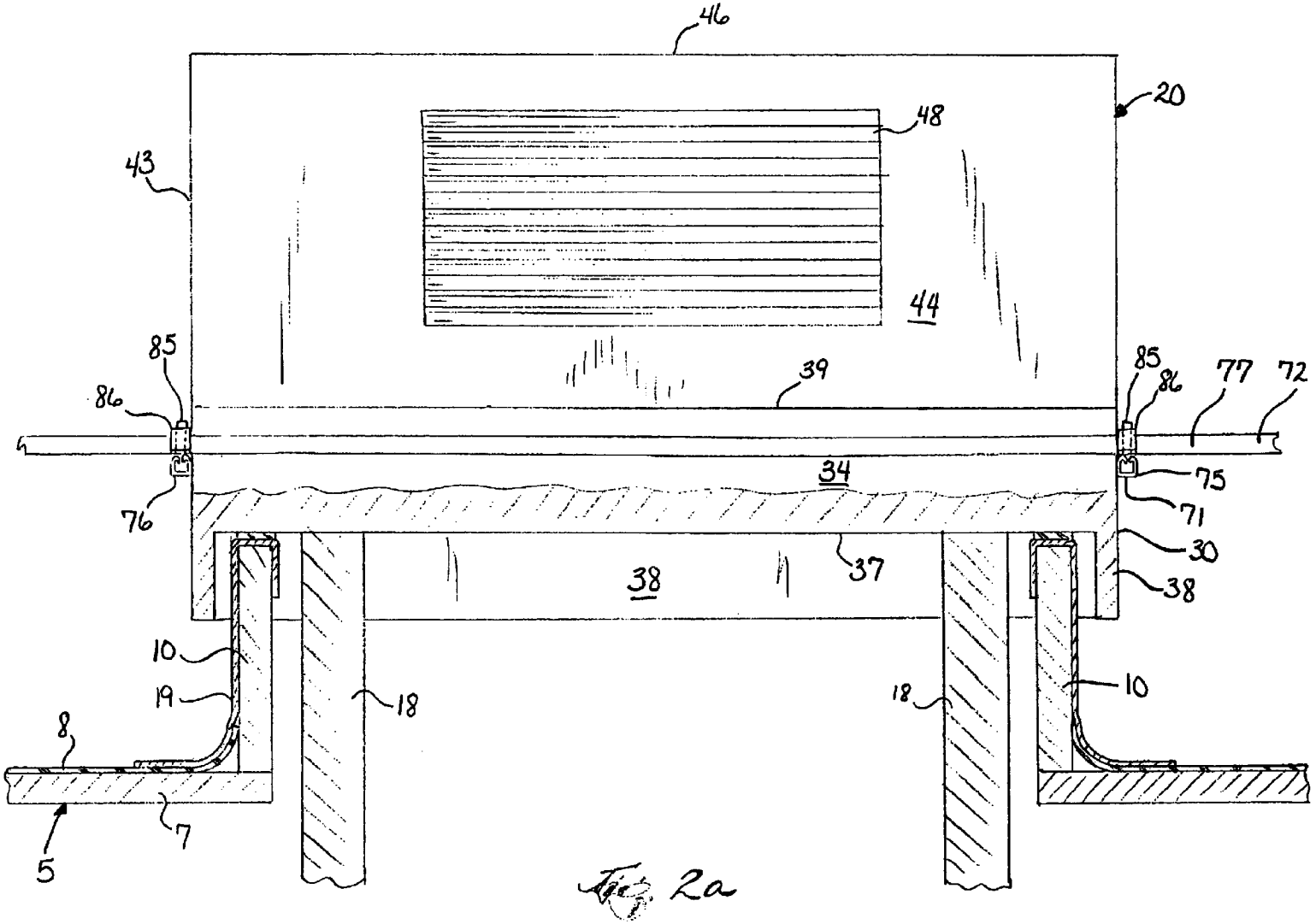
FIG. 2*a* is a cross-sectional view of the roof showing the weatherproof layer sealing against the equipment curb supporting the base of the piece of equipment, with a first set of channels secured directly to the base and a second set of channels secured directly to the first set of channels and indirectly to the base.
Figure 2B:
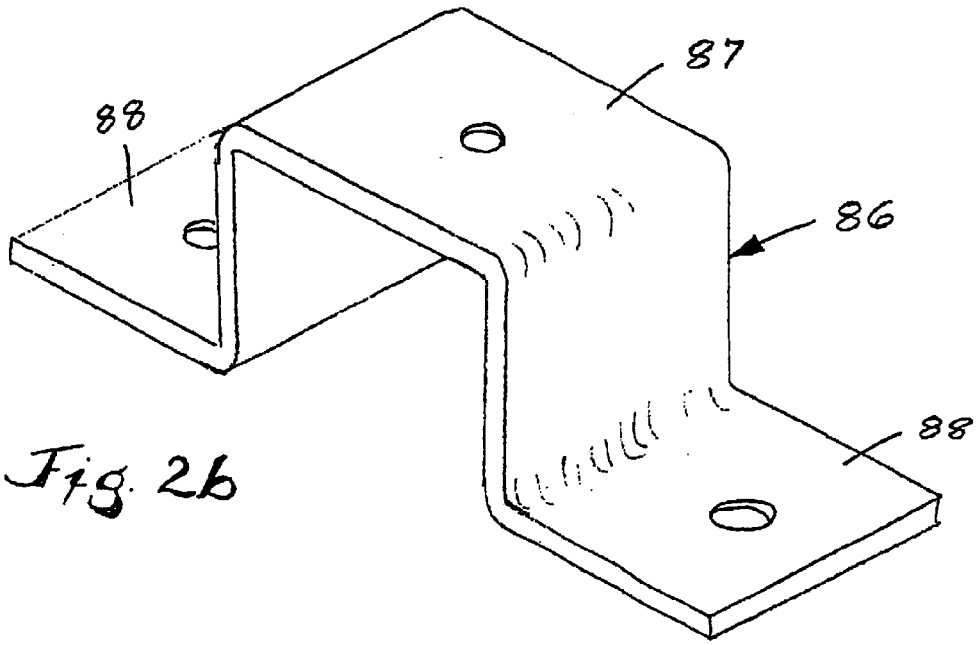
FIG. 2*b* is a perspective view of a U-shaped bracket that connects one channel to another.

FIG. 1 is a top view of a typical commercial building with a flat or substantially flat roof 5. As shown in FIG. 2, the roof 5 has a supporting surface 7 with an upper weatherproof layer 8 that protect the building from the wind, rain, snow, ice, dirt, etc. A number of equipment curbs 10 extend up from the surface 7 of the roof 5 at separate predetermined locations. Each curb 10 is typically designed to support one piece of equipment 20. Each curb 10 is formed by a generally vertical wall with a perimeter 11 that is sized and shaped to engage and support a particular piece of equipment 20. The curb 10 typically includes two opposed, substantially parallel, longitudinal sidewalls 12 and 13 and two opposed, substantially parallel, lateral sides 14 and 15. The walls 12–15 define a generally open central area for receiving the ductwork, pipes, electrical conduit, etc. 18 connected to the internal components (not shown) of the equipment 20. The upper end or rim 17 of the curb 10 is flush with and typically in a single horizontal plane to supportably engage the equipment 20. The weatherproof layer 8 seals against the sides 12–15 of the equipment curb 10. An additional sealing gasket 19 may be used to help form the weatherproof seal between the weatherproof layer 8 and the sidewalls 12–15 of the curb 10. The gasket 19 may or may not extend over the rim 17 of the curb 10 as in FIG. 2.

Roof equipment 20 comes in a variety of sizes and shapes. Some pieces of equipment 20 are relatively large, while others may be considered average or relatively small. A relatively largest piece of equipment 21 has length, width and height dimensions of about ten feet, five feet and eight feet, respectively, but can be as long as forty feet or more. A relatively small piece of equipment 22 has length, width and height dimensions of about three feet each. Average size pieces of equipment 23–25 have dimensions somewhere in between, such as length, width and height dimensions of about eight feet, five feet and four feet, respectively.

The architectural design of a building specifies the location or arrangement of the equipment 20 on the roof 5. For example, in FIG. 1, the large piece of equipment 21 is located by an elevator room 29 and away from the other pieces of equipment. One piece of equipment 23 is located away from any obstructions. The remaining pieces of equipment 22, 24 and 25 are arranged in a cluster 28 relatively close together.

Each piece of equipment 20 has a base 30 that supports its various components, and secures the equipment to one of the curbs 10 of the roof 5. The base 30 is robustly designed and structurally strong. The base typically has a rectangular or box shaped outer perimeter 31 when viewed from above. This perimeter 31 has two opposed longitudinal front and rear sides 32 and 33 and two opposed lateral end sides 34 and 35. The longitudinal sides 32 and 33 are generally parallel, as are the lateral sides 34 and 35. The longitudinal sides 32 and 33 are generally perpendicular to the lateral sides 34 and 35. The longitudinal and lateral sides 32–35 and bottom surface 37 of the base 30 are shaped to matingly receive the sides 12–15 and upper rim 17 of its respective curb 10. The base 30 has a downwardly extending lip 38 and a solid and continuous floor 39 upon which the components of the equipment are secured. The lip 38 extends completely around the perimeter 31 of the base 30, and is sized and shaped to matingly receive and extend around the sides 12–15 of the curb 10. The bottom surface 37 of the base 30 is typically horizontally planar or flat to flushly engage and rest on the similarly shaped rim 17. The floor 39 is continuous from one side of the base to the other. The union of the curb 10 and base 30 sufficiently seals the open central area of the curb.

The weight of the equipment 20 and the mating relationship between the curb 10 and base 30 secure the equipment in place and maintain the seal between the curb and base. The base 30 can be further secured to the curb 10 via one or more bolts, or via connections between the internal components of the equipment 20 to ductwork, pipes or conduit extending through the central portion of the curb 10. While the base 30 of the equipment 20 is shown and described to secure to and seal against the rim 17 of the equipment curb 10, it should be understood that the broad aspects of the invention are not limited to equipment secured to the roof 5 in this manner.

The equipment 20 includes a housing 40 that generally encloses the internal components of the equipment and protects them from the weather and physical abuse. The equipment housing 40 has a perimeter 41 that is typically rectangular or box shaped with four generally planar sidewalls or faces 42–45 and a generally planar top 46. The housing faces 42–45 are generally vertically oriented. The top 46 is generally horizontal. The front and rear faces 42 and 43 of the housing 40 are generally parallel and spaced apart a predetermined width W(eq) of the equipment 20. The side faces 44 and 45 are also generally parallel and spaced apart to define the length L(eq) of the equipment 20. The front and rear faces 42 and 43 are generally perpendicular to the side faces 44 and 45. The base 30 and top 46 are also generally parallel and spaced apart to define the height H(eq) of the equipment 20. An access panel 48 that can be removed to access the internal components of the equipment 20 is located on one of the faces 44 of the equipment 20. The equipment 20 can have one or more components 49 that extend or jut out from the generally planar housing faces 42–45.

The present invention relates to a modular screening assembly that is generally indicated by reference number 50 and shown in FIGS. 2–5. The assembly 50 forms a box or rectangular perimeter 53, but can also take on other shapes as discussed below. The screening assembly 50 has a cantilevered support assembly 55 that includes at least two sets of channels 60 that support a generally vertically oriented, upwardly extending framework 100. The framework 100 is formed by a number of frame sections 102–105 and like-shaped frame segments 110 that hold a number of like-shaped panels 300.

Figure 6:
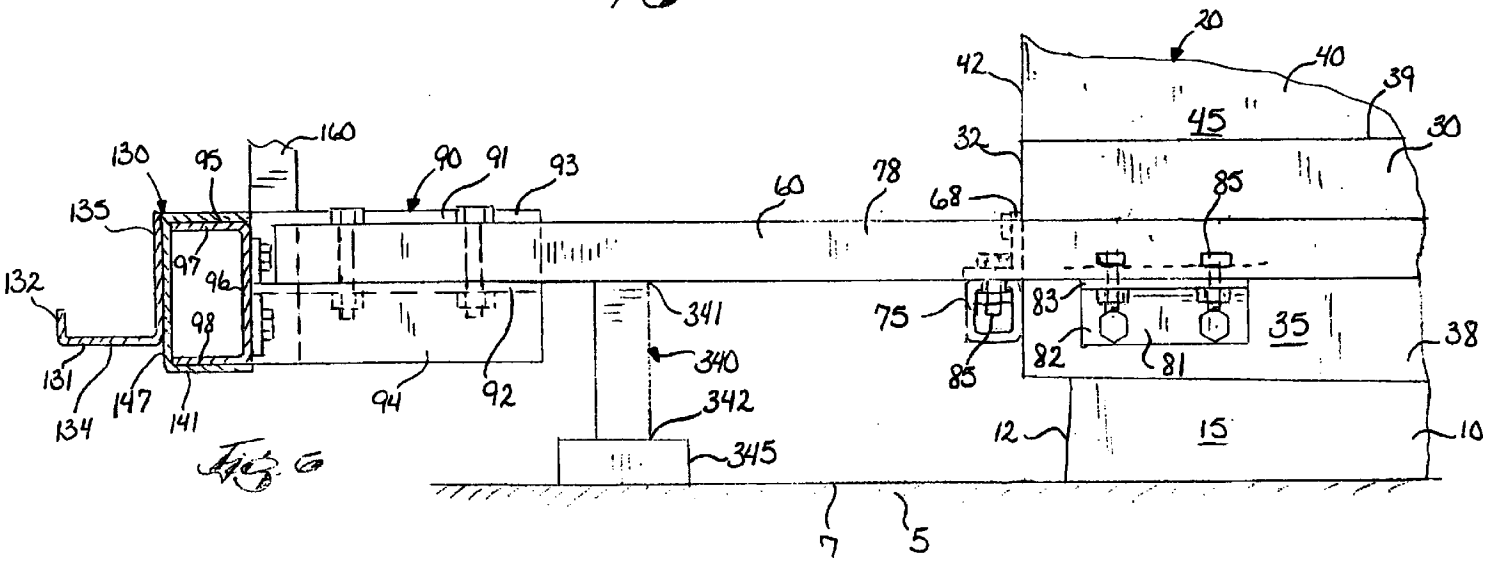
FIG. 6 is a sectional view taken along line 6—6 of FIG. 5 showing the substantially parallel alignment and securement of the channels to the equipment base and showing a channel connected to and supporting a section of the framework.

The supports or channels 60 are made of metal and robustly designed to carry the weight of the framework 100, as well as wind and other associated loads. Each channel has a similar cross sectional shape that forms a three-sided square when viewed in cross section as shown in FIGS. 2 and 6. Each channel 60 has two opposed flanges 61 and 62 joined by a web 63, and an open side 64. Several equally sized holes are formed through the web 63 at predetermined intervals down the length of each channel 60. Acceptable channels 60 are made by UniStrut, Inc., of Itasca, Ill., Cooper B-Line, Inc., of Highland, Ill., or the like. Although the supports or channels 60 are shown and described with a relatively square and tubular, cross sectional shape, it should be understood that the channels could have other cross sectional shapes or be solid without departing from the overall aspects of the present invention.

Figure 4:
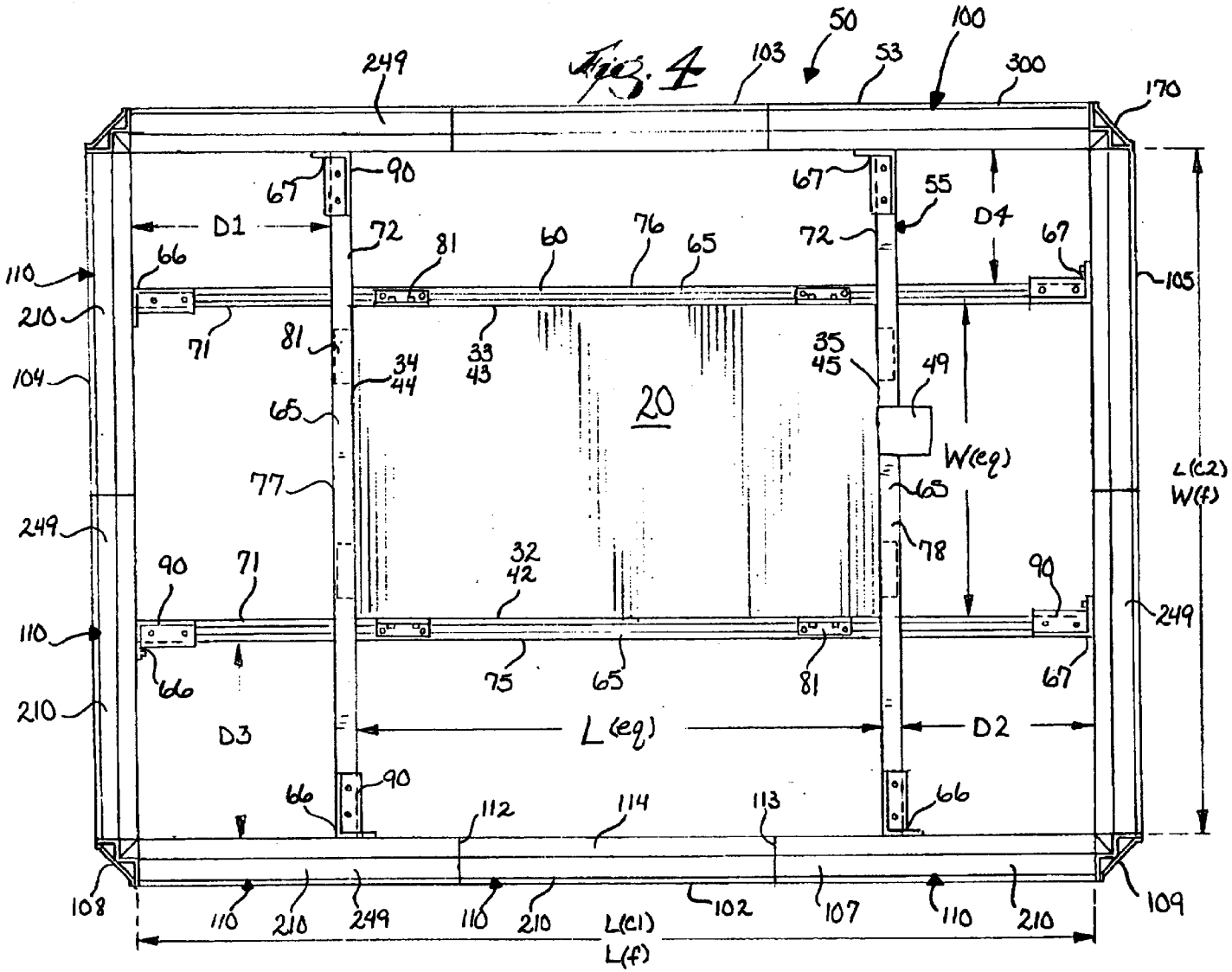
FIG. 4 is a top view of the present screening assembly invention showing the alignment of the sets of channels and channel ends in the support assembly, with each channel being secured directly to the base of the equipment and each set common channel ends supporting a section of the framework.
Figure 4A:
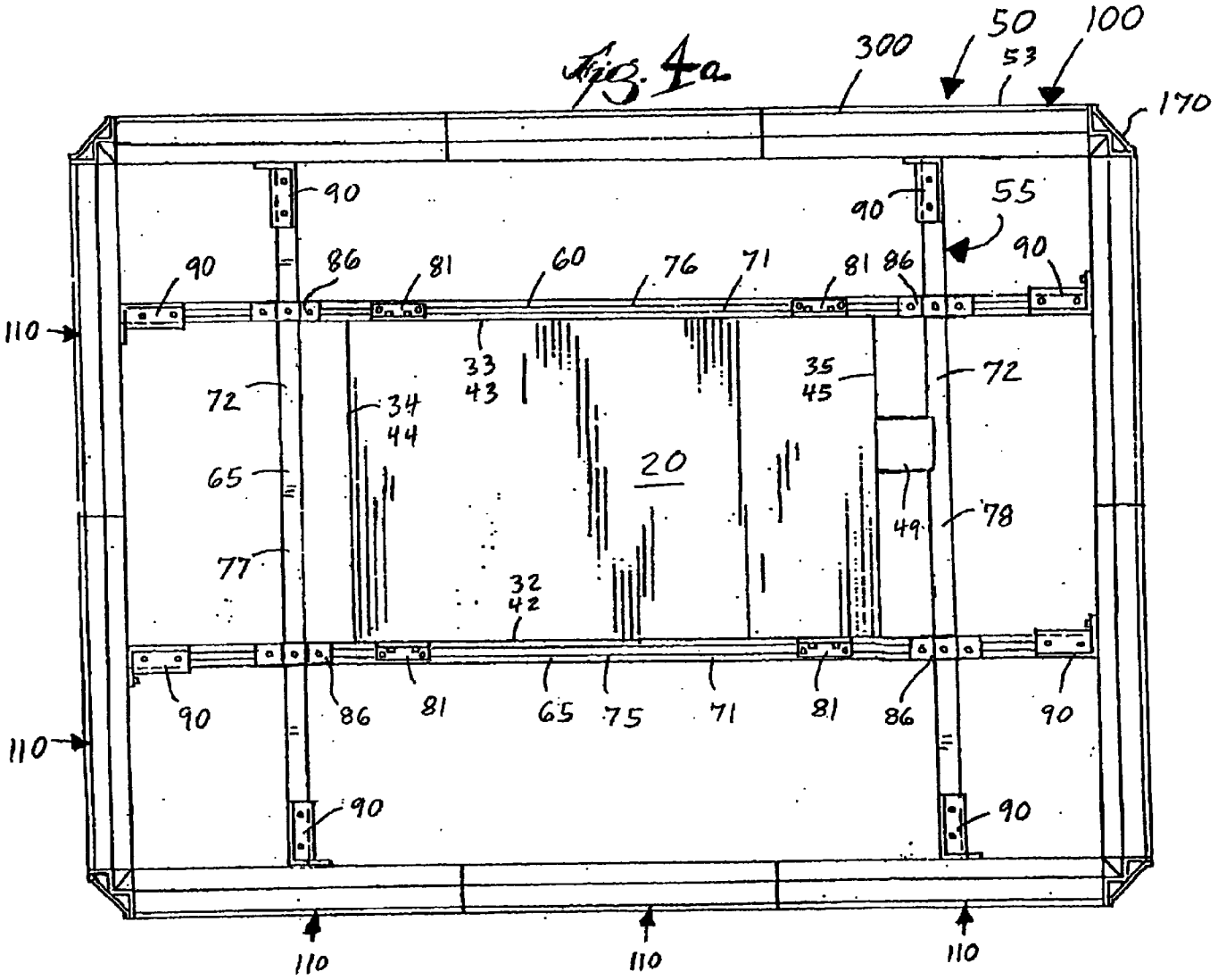
FIG. 4*a* is a top view of the present screening assembly invention showing the alignment of the sets of channels and channel ends in the support assembly, with the first set of channels being secured directly to the base of the equipment and the second set of channels being secured to the first set of channels.

The cantilevered support assembly 55 extends in multiple directions from the base 30 of the equipment 20 as shown in FIG. 4. For the rectangular piece of equipment 20 shown, the assembly 55 preferably includes four support or mounting channels 60. Each channel 60 is longer than the side 32–35 of the base 30 to which it is attached. Each channel 60 has a mid section or center region 65 and opposed first and second ends 66 and 67 that define the length of the channel.

In the embodiment shown in FIGS. 4 and 6, the mid section of each mounting member or channel 60 is bolted or otherwise rigidly secured directly to one of the four sides 32–35 of the base 30 of the equipment 20, as shown in FIGS. 4 and 6. One channel 60 is flushly aligned with and secured to each of the four sides or faces 32–35 of the base 31. Each channel end 66 and 67 is cantilevered from the base 30 to extend outwardly a predetermined distance beyond the associated face 42, 43, 44 or 45 of the housing 40 from which they extend. The opposed ends 66 and 67 of each channel 60 can be cantilevered different amounts to provide a desired amount of clearance between the framework and the opposed faces 42–45 of the housing 40 as discussed below.

One or more L-shaped brackets 68 are used to secure each channel 60 to the base 30. Each bracket 68 is aligned so that its vertical portion 68*a* flushly engages the base 30 with its horizontal portion 68*b* extending out from the base to form a platform for mounting one of the channels 60. This vertical portion 68*a* is bolted or otherwise rigidly secured to the base 30. The channel 60 is then flushly aligned with and bolted or otherwise rigidly secured to the horizontal portion 68*b*. The horizontal portions 68*b* are located in substantially the same horizontal plane. A cooperating bolt and nut assembly 69 passes through one of the holes in the web 63 and the open end 64 of the channel 60 and a hole in the horizontal portion 68*b* to rigidly secure the channel to the bracket 68, and thus the base 30 of the equipment 20.

Although the base 30 is shown and described as having a four sided geometry with each side 32–35 having a continuous flat surface against which one of the channels 60 can flushly engage, it should be understood that the base could take on different shapes without departing from the overall aspect of the invention. For example, the base 30 could have openings in each side 32–35 extend from one side of the base to the other, and one or more of the channels 60 could pass through these openings. In addition, although the channels 60 are shown and described as being secured to the sides 32–35 of the base 30, it should be understood that in certain situations the channels can be secured to the sides of the curb 10. For example, the channel 60 can be secured to the curb 10 when the equipment curb 10 extends high enough above the roof 5 to allow sufficient clearance or access to the curb, and the weatherproof layer 8 either does not completely cover the curb, or penetrating the weatherproof layer and drilling a hole in the curb is not a concern.

The cantilevered, multi-directional support assembly 55 is preferably formed by two sets 71 and 72 of channels 60 as shown in FIG. 4. The first set 71 includes a channel 75 mounted to the front side 32 of the base 30 and a second channel 76 mounted to the rear side 33. The longitudinal channels 75 and 76 are aligned in a substantially planar and substantially parallel orientation. The ends 66 and 67 of the channels 75 and 76 form two opposed sets of matched or common ends. Ends 66 of set 71 form a first set of common ends that extends from side 34 of base 30. Ends 67 of set 71 form a second set of common ends that extends from side 35 of base 30. The channels 75 and 76 are of substantially equal length and in common registration. Each common end 66 in set 71 extends substantially the same distance D1 beyond their common housing face 44. Each common end 67 in set 71 extends substantially the same distance D2 beyond their common housing face 45.

Similarly, channel set 72 includes a first channel 77 mounted to the first end side 34 of the base 30 and a second channel 78 mounted to the second end side 35. The lateral channels 77 and 78 are aligned in a substantially planar and substantially parallel orientation. The ends 66 and 67 of the channels 77 and 78 form two opposed sets of matched or common ends. Ends 66 of set 72 form a third set of common ends that extend from side 32 of base 30. Ends 67 of set 72 form a fourth set of common ends that extends from side 33 of base 30. The channels 77 and 78 are of substantially equal length and in common registration. Each common end 66 in set 72 extends substantially the same distance D3 beyond their common housing face 42. Each common end 67 in set 72 extends substantially the same distance D4 beyond their common housing face 43.

Each channel 75–78 has a specific length to obtain the desired amount of workspace or clearance D1, D2, D3 or D4 between the framework 100 and the faces 42–45 of the equipment housing 40. The length L(c1) of each channel 75 and 76 in the first set 71, and the length L(c2) of each channel 77 and 78 in the second set 72 are as follows:

$$L(c1)=L(eq)+D1+D2 \text{ and } L(c2)=W(eq)+D3+D4$$

where:

L(c1) is the length of channels 75 and 76 in set 71,

L(c2) is the length of channels 75 and 76 in set 72,

L(eq) is the length of the equipment 20,

W(eq) is the width of the equipment 20,

D1 is the desired clearance along housing face 44,

D2 is the desired clearance along housing face 45,

D3 is the desired clearance along housing face 42, and

D4 is the desired clearance along housing face 43.

The desired clearances or workspace D1, D2, D3 and D4 can be adjusted to be the same or different along each housing face 42–45. Although FIG. 4 shows distances D1 and D2 to be about the same, these distances can differ. Distance D1 can be greater or less than D2 to provide more or less clearance along housing face 44. Similarly, distances D3 and D4 can differ to provide more or less clearance along housing face 42 or 43. Although FIG. 4 shows a support assembly 55 for a rectangular shaped framework 100 where distances D1, D2, D3 and D4 are generally constant from one side of the equipment 20 to the other, it should be understood that the broad aspect of the invention includes support assemblies for frameworks 100 having other geometric shapes such as a trapezoid or the like where the distances D1–D4 are not constant from one side of the equipment or housing to the other. The framework 100 could also take on a pentagon, hexagon, or octagon shape without departing from the broad aspects of the invention.

Each set of common ends 66 or 67 in the multi-directional support assembly 55 extends in a different direction from the equipment 20. The channels 75 and 76 forming channel set 71 extend in a direction that is substantially perpendicular to the direction of the channels 77 and 78 forming channel set 72. The sets of common ends 66 and 67 are substantially planar. Both sets 71 and 72 of channels 60 are substantially planar to each other, although channels 75 and 76 of set 71 are slightly offset from channels 77 and 78 of set 72. The downwardly facing, open end 64 of the upper channels 75 and 76 abut the upwardly facing, open end 64 of the lower channels 77 and 78.

Although the channels 60 are shown arranged to form two perpendicular sets 71 and 72 of parallel channels, it should be understood that this arrangement could be altered depending on the geometry of the equipment base 30 so that each channel is flushly joined to one face or wall of the base. In addition, although each set of channels 71 and 72 is shown and described as being formed by two channels 75 and 76 or 77 and 78, it should be understood that each set of channels could include one or more additional channels if desired. For example, a larger piece of equipment may include one or more central channels that extend through the base and between one of the outer channels 75 and 76 or 77 and 78. The broad aspects of the invention are also not limited to equipment 20 having a rectangular shaped base 30 as in FIGS. 3 and 4, nor to a piece of equipment where the sides 32–35 are flush with or in the same plane as the sides 42–45 of the equipment housing 40.

Figure 6A:
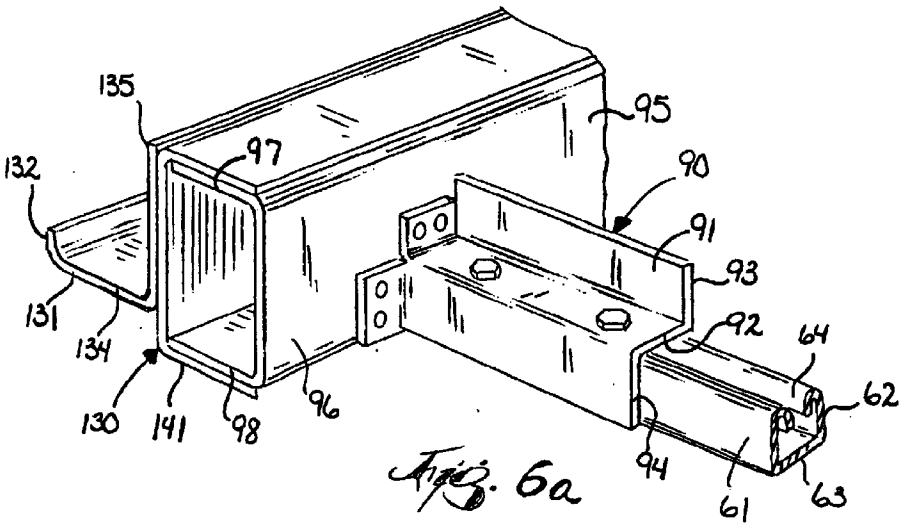
FIG. 6*a* is a perspective view of an end of a channel and its bracket secured to a lower rail of a frame section.

Each channel 60 has two brackets 90 that join it to the framework 100. As shown in FIGS. 6 and 6*a*, one bracket 90 is located at each end 66 and 67 of each channel 60. Each bracket 90 has the same shape and size, and can be used on either end 66 or 67 of the like-shaped channels 60. The bracket 90 includes an inner portion 91 that is bolted or otherwise rigidly secured to one of the ends 66 or 67 of the channel 60. The inner portion 91 has a Z-shape formed by a horizontal web 92 and two opposed vertical flanges 93 and 94. The horizontal web 92 and one of the vertical flanges 93 or 94 are positioned flush against one of the ends 66 or 67 the channel 60. The open end 64 of the channel 60 faces the horizontal web 92. The horizontal web 92 of each bracket 90 is in the same horizontal plane as the horizontal portion 68*b* of each L-shaped bracket 68. Once the bracket 90 is properly aligned on the end 66 or 67 of a channel 60, the inner portion 91 is bolted or otherwise rigidly secured to the channel 60. The bracket 90 has an outer portion or mount 95 for supportably engaging and rigidly securing the framework 100. The mount 95 has a U-shaped cross section shape formed by a vertical side web 96 and top and bottom flanges 97 and 98. The side web 96 is welded or otherwise integrally attached to one end of the inner portion 91 so that they form an integral part. The horizontal web 92 of the inner portion 91 intersects the center of the vertical web 96 of the outer mount 95. The open end of the mount 95 is in line with and faces away from the end 66 or 67 of the channel 60 to which it is secured.

The framework 100 continues the bottom-up construction of the support assembly 55. The framework 100 has a bottom end or lower portion 106 and a top end or upper portion 107. The lower portion 106 of the framework 100 is rigidly secured to and supported by the channels 60 and their brackets 90. The framework 100 extends in a substantially vertical direction to its upper end 107. The distance between the upper 106 and lower 107 ends defines the height H(f) of the framework 100. The lower portion 106 of the framework 100 carries the full weight of the framework 100 and fully support its upper portions 107 as discussed below.

The framework 100 generally defines the outer margins 53 of the screening assembly 50. The framework 50 typically includes a front frame section 102, a rear frame section 103 and two opposed side frame sections 104 and 105. The distance between the front 102 and rear 103 longitudinal sections defines a width W(f) of the framework 100. The distance between the first 104 and second 105 lateral sections defines its length L(f). Each section 102–105 has upper and lower ends 106 and 107 and opposed sides 108 and 109. In the embodiment shown in FIGS. 3–5, the length L(c1) of the longitudinal channels 75 and 76 in set 71 is substantially equal to the length of the framework L(f). Similarly, the length L(c2) of the lateral channels 77 and 78 in set 72 is substantially equal to the width of the framework W(f).

Each desired clearance or workspace D1–D4 remains substantially horizontally and vertically constant to create a substantially constant workspace or clearance between each frame section 102–105 and its corresponding housing face 42–45. The front section 102 is parallel to and located a constant horizontal distance D3 from the front housing face 42. The rear section 103 is parallel to and is located a constant horizontal distance D4 from the rear housing face 43. Side section 104 is parallel to and is located a constant horizontal distance D1 from the housing face 44. Side section 105 is parallel to and is located a constant horizontal distance D2 from the housing face 45. Distances D1–D4 remain substantially vertically constant from the bottom end of the framework 100 to the top end of the framework and substantially horizontally constant from one side 108 of each frame section 102–105 to the other 109.

The framework 100 is formed by a plurality of like-shaped frame segments 110. Each frame section 102–105 is formed by one or more frame segments 110. Each frame segment 110 has a preferably rectangular shaped perimeter with opposed ends 112 and 113 that define its length L(fs) and top and bottom ends 114 and 115 that define its height. The height of each frame segment 110 is equal to the height H(f) of the framework 100. Each frame segment 110 is formed by a lower frame member 130, two posts 150 and an upper frame member 210. The upper and lower frame members 130 and 210 are substantially parallel and of equal length L(fs).

Each lower frame members or lower rail segment 130 has the same shape and dimensions. Each like-shaped segment 130 has an outer panel platform 131 and an inner support member 141 as in FIGS. 6–9. Each panel platform 131 is riveted or otherwise rigidly secured to its corresponding support member 141. Each like shaped panel platform 131 has a vertical outer lip 132, a horizontal platform 134, and a vertical riser 135. The lip 132, platform 134 and riser 135 form a U-shape that is sized to receive one of the panels 300 as discussed below. Each segment 130 has first and second ends 138 and 139 that define the length L(fs) of the segment shown in FIG. 5. The width of the horizontal platform 134, the height of the lower lip 132 and the length of the lower frame segment 130 are sized to slidingly and securely receive one of the panels 300 as discussed below.

The support members 141 are robustly designed to reinforce their corresponding panel platform 131. Each like-shaped support member 141 spans the length of its corresponding like-shaped panel platform 131. Each support member 141 is formed by a U-shaped channel laid on its side with its open end facing inwardly. The channel 141 has a top horizontal flange 142, a vertical web 144, and a bottom horizontal flange 145. The horizontal flanges 142 and 145 are spaced apart a predetermined distance or height. The vertical web 144 of support 141 lays flush against the vertical riser 135 of panel platform 131. The horizontal platform 134 is parallel to and offset a specific distance above the bottom horizontal flange 145. This offset forms a step or abutment 147 for aligning and securing a second framing tier atop the existing framework 100, as discussed below.

The lower frame segments 130 in a given frame section 102, 103, 104 or 105 combine to form a bottom rail 149 for that section. The bottom rail 149 of a particular section 102, 103, 104 or 105 has a length that is roughly equal to the number of frame segments 110 in that section. The length of the longitudinal bottom rails 149 is roughly equal to the length L(f) of the framework 100, and the length of the lateral bottom rails 149 is roughly equal to the width W(f) of the framework. For example, the rectangular shaped screening assembly 50 shown in FIG. 3 has three frame segments 110 along its length L(f) and two frame segments along its width W(f). As each frame segment 110 has the same length (Lfs), the length L(f) of the framework 100, the length L(c1) of the longitudinal channels 75 and 76 in set 71, and length of the longitudinal bottom rails 149 in longitudinal sections 102 and 103 are both about three times the length L(fs) of frame segment 110. Similarly, the width W(f) of the framework 100, the length L(c2) of the lateral channels 77 and 78 in set 72, and length of the bottom rails 149 in lateral sections 104 and 105 are both about two times the length L(fs) of the frame segment 110.

$$L(f)=L(c1)=N(1) \text{ times } L(fs)$$

$$W(f)=L(c2)=N(w) \text{ times } L(fs)$$

where:

L(f) is the length of the framework 100,

W(f) is the width of the framework 100,

N(1) is a whole number greater than or equal to one,

N(2) is a whole number greater than or equal to one, and

L(fs) is the length of a single frame segment 110.

Each longitudinal lower rail 149 is connected to one pair of common ends 66 or 67 of channels 77 and 78 in lateral channel set 72. Each lateral lower rail 149 is connected to one pair of common ends 66 or 67 of channels 75 and 76 in longitudinal channel set 71. As noted above, each channel end 66 and 67 has a bracket 90 that connects it to its lower rail 149 as shown in FIGS. 4, 6 and 6*a*. The open end of support member 141 is sized slightly larger than the outer mounting portion 95 of bracket 90. The open end of support members 141 forming the lower rail 149 of each section 102, 103, 104 or 105 snugly and slidingly receive the two mounts 95 of its corresponding common ends 66 or 67 of channel sets 71 or 72. The support members 141 of the bottom rail 149 are preferably bolted or otherwise rigidly but removably secured to the mounting portions 95 of the brackets 90.

The framework 100 has a number of upwardly extending posts 150. These posts 150 include intermediate posts 160 and corner posts 170. Each post 150 is aligned in a substantially vertical orientation, and each post is generally parallel to the other posts. Each post 150 is spaced apart from its two adjacent posts a predetermined distance substantially equal to one frame segment L(fs). As noted above, each frame segment 110 includes two adjacent posts 150. Adjacent frame segments 110 share a common post. Each post 150 has top and bottom ends 151 and 152 that define its height, which is substantially equal to the height H(f) of the framework 100.

Each intermediate riser or post 160 connects two adjacent and parallel frame segments 110 in the same frame section 102–105 as shown in FIGS. 3 and 7–10. Each post 160 has the same shape and dimensions. Each like-shaped post 160 includes a robustly sized channel with a generally rectangular cross sectional shape. Each post 160 has top and bottom ends 161 and 162, and two like-shaped couplers 163 and 164. Each coupler 163 and 164 preferably has the same construction, shape and dimensions, and are preferably interchangeable. The top coupler 163 is located proximal the top end 161, and the bottom coupler 164 is located proximal the bottom end 162. The couplers 163 and 164 are spaced a predetermined distance apart. Each coupler 163 and 164 has an upper horizontal flange 166, a rear vertical web 167 and a lower horizontal flange 168. The upper and lower horizontal flanges 166 and 168 are spaced apart a predetermined distance. Each coupler 163 and 164 is welded or otherwise rigidly secured to its post 160 so that the vertical web 167 of each coupler is in the same plane, and the flanges 166 and 168 of each coupler extends in the same direction.

Figure 3:
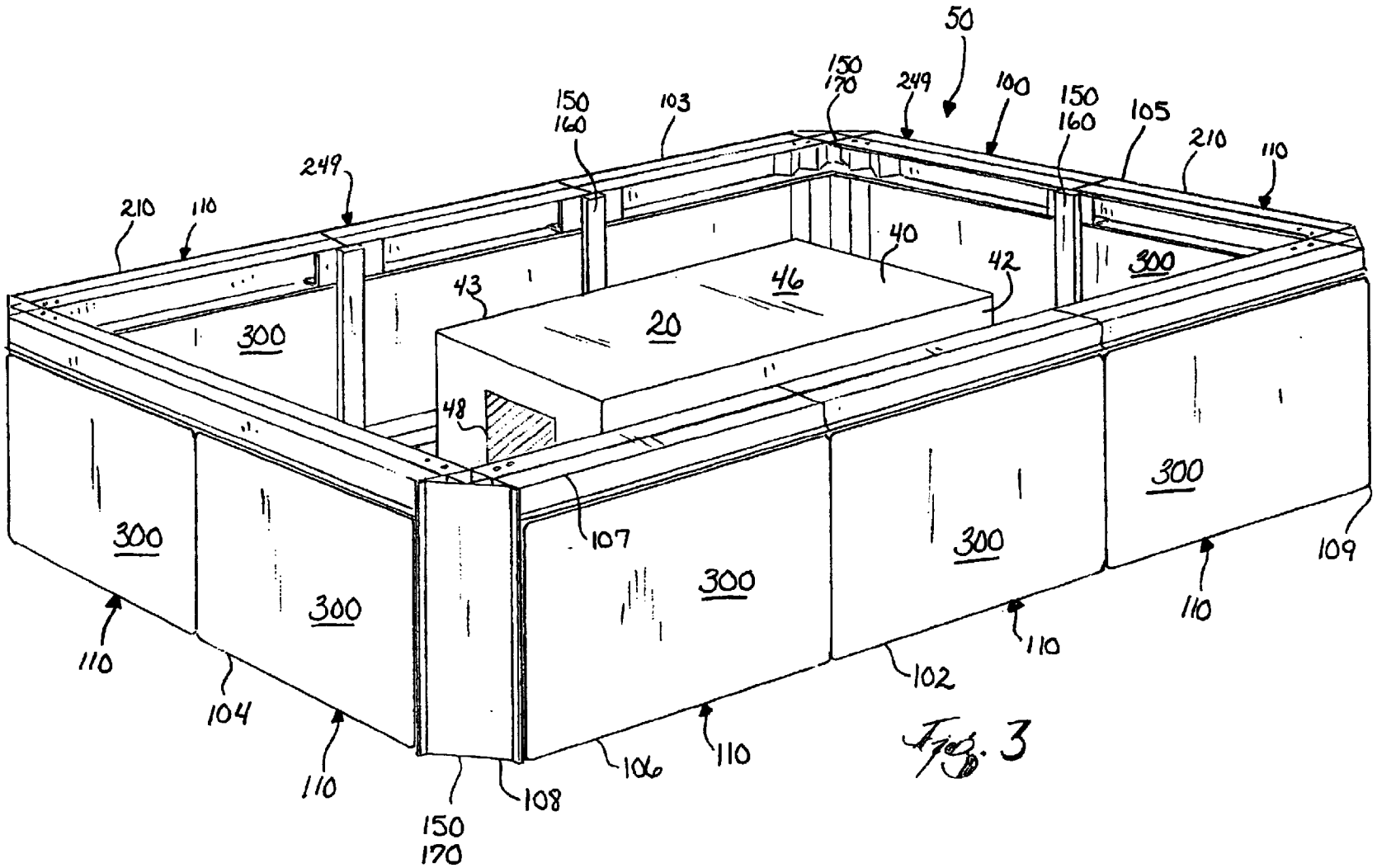
FIG. 3 is a perspective view of the present roof screening assembly invention having a framework formed by four sections that are each parallel to their associated side of the equipment housing.
Figure 9:
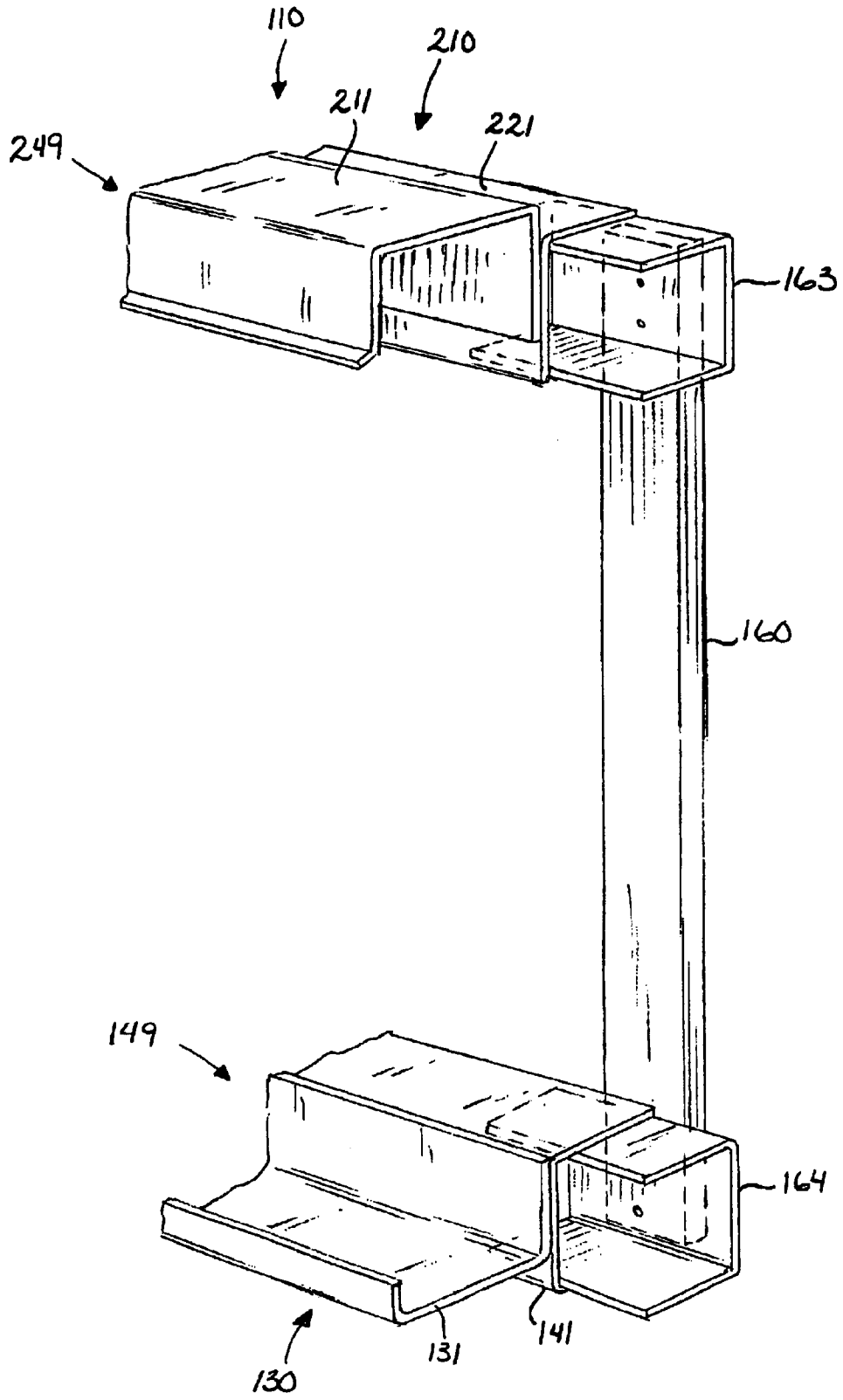
FIG. 9 is a perspective view of the intermediate post and lower and upper frame rail segments.

The bottom coupler 164 snuggly fits inside the open ends of two adjacent support member 141 of lower rail segments 130 as shown in FIGS. 3 and 9. The bottom coupler 164 is matingly received into open end of the support member 141, and preferably bolted or otherwise rigidly, but removably, secured to the support member 141 of each of its adjacent lower frame members 130. Each intermediate post 160 straddles and rigidly joins two adjacent frame segments 110 in a common section 102–105. The post 160 is a part of each adjacent segment 110.

The corner risers or posts 170 connect two adjacent frame segments 110 from adjoining sections 102–105 of framework 100 as shown in FIGS. 3, 5 and 11–13. Each corner post 170 has the same shape and dimensions. Each like-shaped corner post 170 has a main riser 171 that includes an outer, substantially flat web 172 that is welded or otherwise integrally joined to an inner W-shaped web 174. The ends and middle bend of the web 174 engage the ends and middle portion of the flat web 172, respectively. The main riser 171 has top and bottom ends 175 and 176 that define its height, which is substantially equal to the height H(f) of the framework 100.

Figure 11:
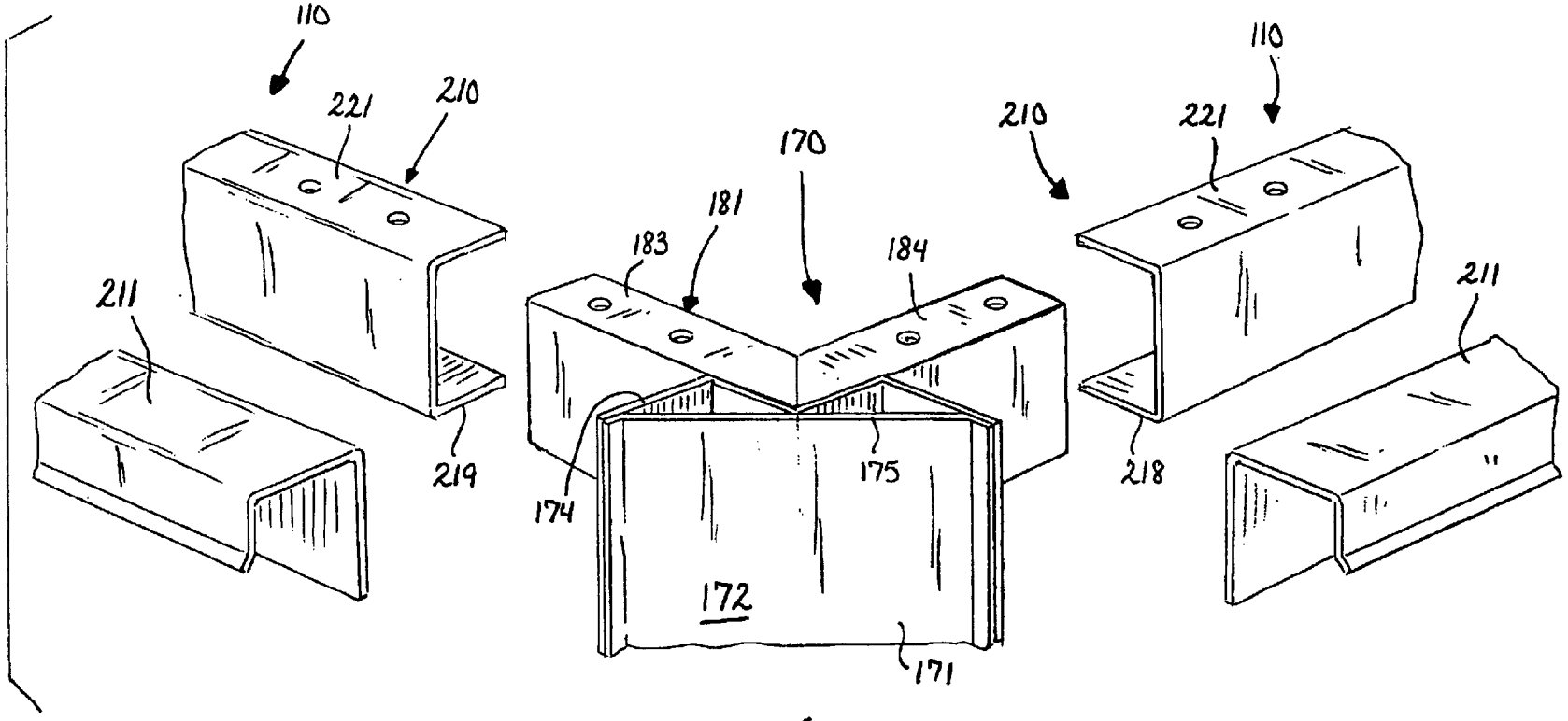
FIG. 11 is an exploded view of a corner post and its top corner coupler aligned with two adjacent top rails.
Figure 13:
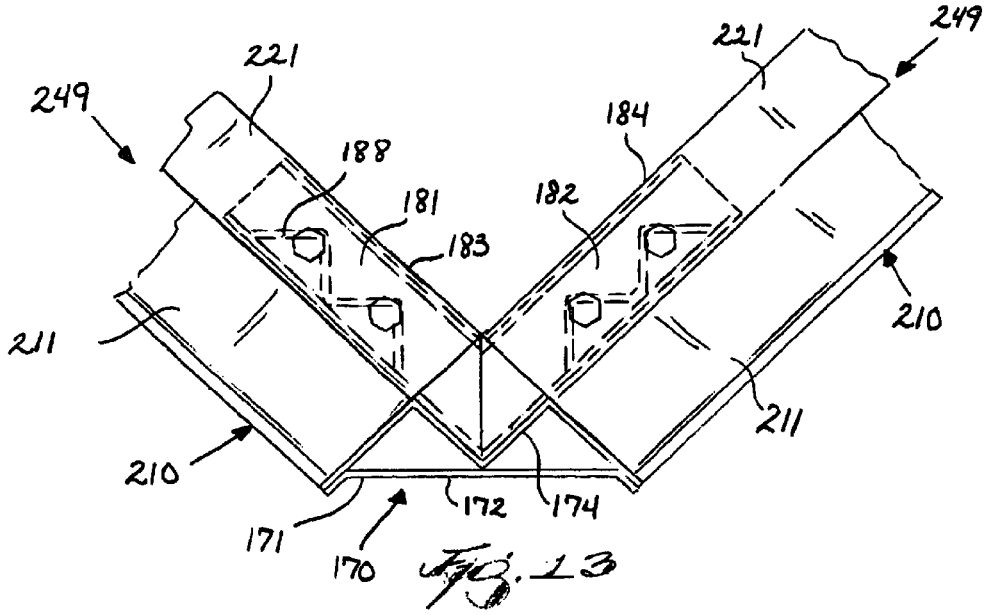
FIG. 13 is a top view of the corner post connected to its two adjacent top rails.
Figure 12:
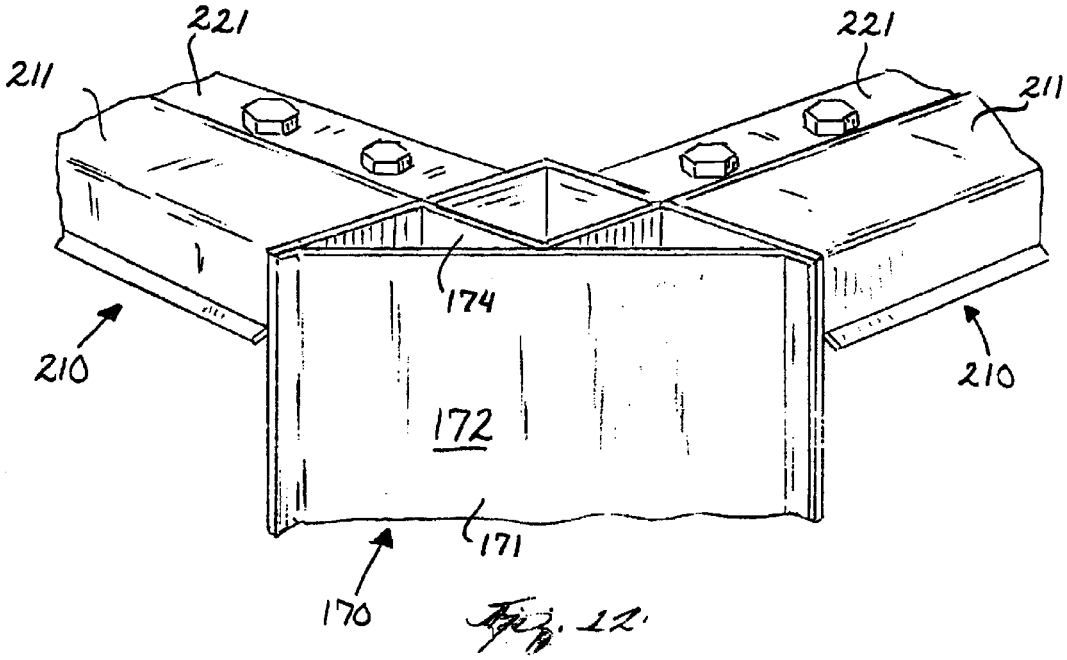
FIG. 12 is a perspective view of the corner post connected to its two adjacent top rails.

Each corner post 170 includes a top coupler 181 located proximal its top end 175 and a bottom coupler 182 located proximal its bottom end 176. Each coupler 181 and 182 has the same construction, shape and dimensions as shown in FIGS. 11–13. The like-shaped couplers 181 and 182 are preferably interchangeable, and formed by the same component parts so that the parts are interchangeable. Each coupler 181 and 182 is welded or otherwise rigidly secured to one of the ends 175 and 176 of its respective corner post 170. The couplers 181 and 182 are spaced a predetermined distance apart, that is substantially equal to the distance between the couplers 163 and 164 of posts 160.

Each coupler 181 and 182 is formed from a single integral U-shaped channel that is notched and bent to form first and second like-shaped channels 183 and 184. As shown in FIGS. 12 and 13, the channels 183 and 184 are integrally joined at the middle of couplers 181 and 182. Each channel 183 and 184 extends horizontally from the post 170 in different directions. The channels 183 and 184 extend in directions that are 90 degrees apart so that each channel is perpendicular to the other. Each channel 183 and 184 has a top horizontal flange 185, a vertical web 186 and a bottom horizontal flange 187. Each channel 183 and 184 has a corresponding stiffener 188 that is welded or otherwise rigidly secured between its flanges 185 and 187. The flanges 185 and 187 are spaced apart a distance slightly less than that between flanges 142 and 143 of support 141. One of the channels 183 or 184 of bottom coupler 182 is matingly received between the flanges 142 and 145 of each adjoining lower frame member 130. One of the channels 183 or 184 of top coupler 181 is matingly received between the flanges 222 and 225 of each adjoining upper frame member 210, discussed below.

The bottom coupler 182 snuggly fits inside the open end of the lower supports 141 for two adjacent lower rail segments 130. This union is similar to the manner the bottom coupler 164 of intermediate post 160 fits inside support 141. The bottom coupler 182 is matingly received into open end of the support 141, and preferably bolted or otherwise rigidly, but removably, secured to the support member 141 of each of its adjacent lower frame members 130. Each corner post 170 rigidly joins two adjoining frame segments 110 together. The post 170 is a part of each adjacent segment 110.

Figure 7:
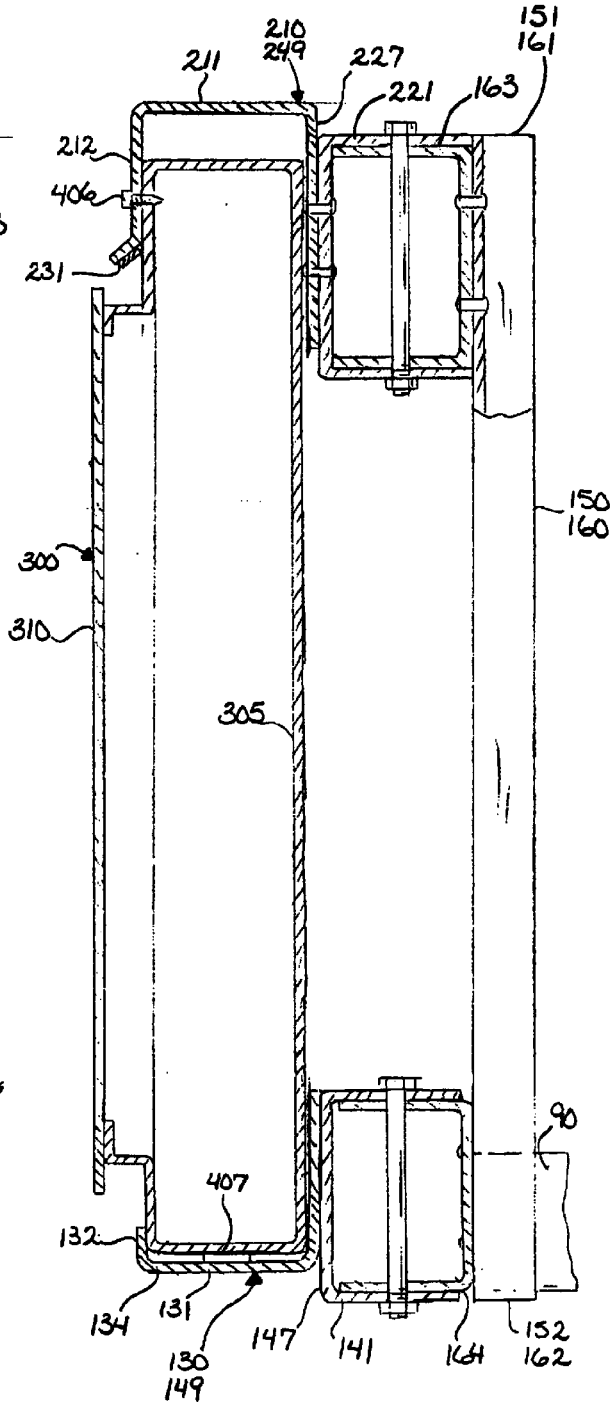
FIG. 7 is a sectional view taken along line 7—7 in FIG. 5 showing a panel secured to frame segment having lower and upper frame rail segments and an intermediate post.
Figure 8:
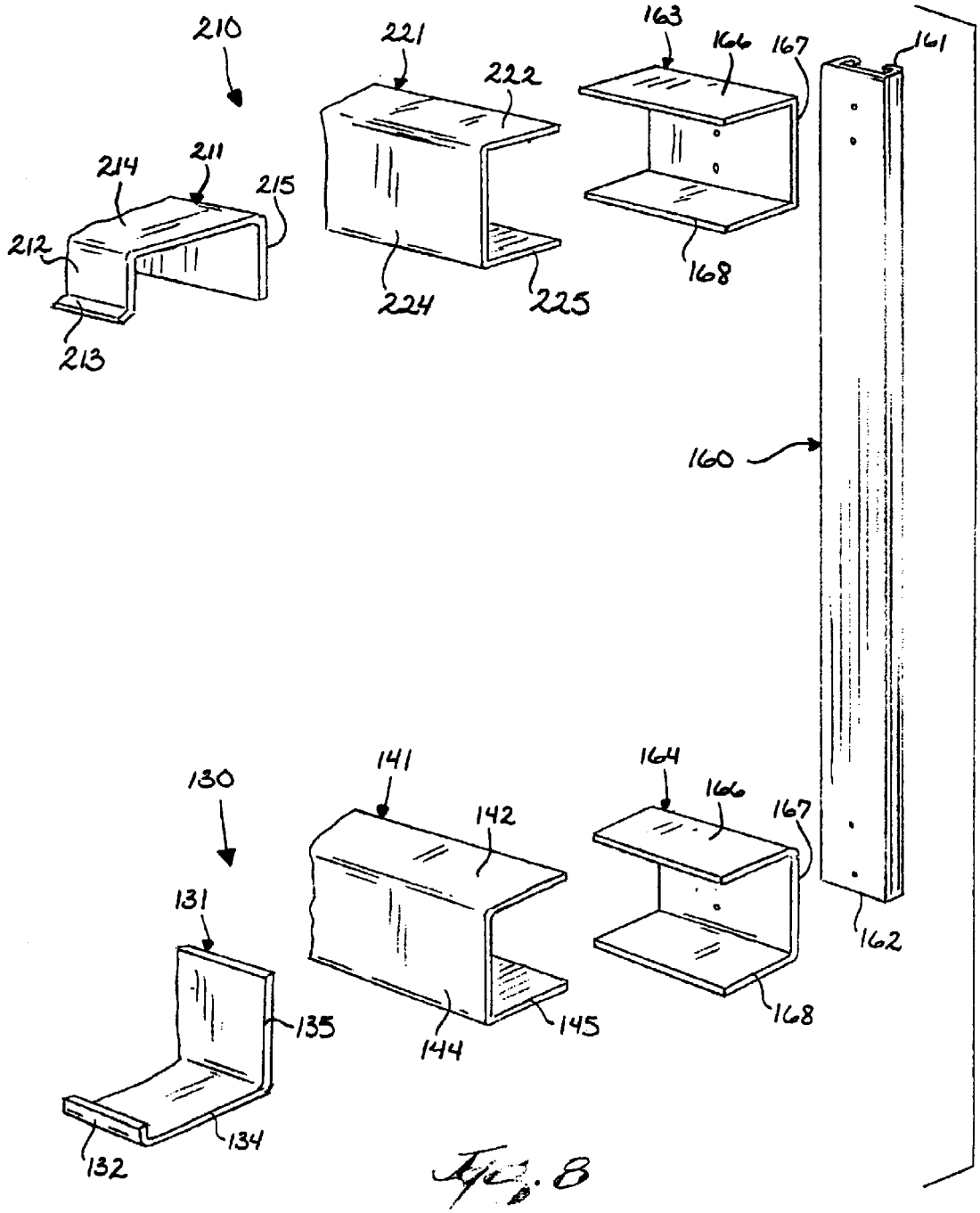
FIG. 8 is an exploded view of the intermediate post and lower and upper frame rail segments.

The upper frame members or upper rail segments 210 are similar in construction to the lower rail segments 130. As shown in FIGS. 7–9, each upper rail segment 210 is substantially a mirror image of the lower frame member 130. Each upper frame member 210 has the same shape and dimensions. Each like-shaped upper frame member 210 has an outer panel cover or catch 211 and an inner support member 221. The panel catch 211 is riveted, welded or otherwise rigidly secured to the support member 221 to form an integrally connected part 210. The panel catch 211 has a vertical outer lip 212 with an outwardly angled end 213, a horizontal spacing web 214 and a vertical riser 215. The lip 212, spacing web 214 and riser 215 form a U-shape that is sized to receive an end of one of the panels 300 as discussed below. The lip 212 and riser 215 of the panel cover 211 are spaced a predetermined distance or width apart, which is substantially equal to the width of the panel platform 131. The lip 212 of the upper frame member 210 has a desired height. Each upper rail segment 210 has a first end 218 and a second end 219. These ends 218 and 219 are spaced apart a predetermined distance or length that is substantially equal to the length of the lower rail segment 130 and is slightly greater than the length of the panel 300. The width of panel cover 214, the height of lip 212 and the length of upper rail segment 130 are sized to slidingly and securely receive one of the panels 300 as discussed below.

The support 221 of each upper rail segment 210 is robustly designed to reinforce its corresponding panel cover 211. The support 221 spans the length of its corresponding panel cover 211. The support 221 is formed by a U-shaped channel laid on its side so that its open end faces inwardly. The channel 221 has a top horizontal flange 222, a vertical web 224, and a bottom horizontal flange 225. The horizontal flanges 222 and 225 are spaced apart a predetermined distance. The vertical web 224 lays flush against the vertical riser 215 of the panel catch 211. The horizontal spacing web 214 of the panel catch 211 is parallel to and offset a specific distance above the plane containing the top horizontal flange 222 of the support member 221. This offset forms a step or abutment 227 for aligning a second upper framing tier atop the upper rail segment 210 of the first tier of the framework 100, as discussed below.

As shown in FIGS. 7–13, the top couplers 163 or 181 of post 160 and 170 snuggly fit inside the open side of the upper supports 221 of two adjacent upper rail segments 210. As noted above, the bottom couplers 164 or 182 of posts 160 and 170 snuggly fit inside the open side of the lower supports 141 of two adjacent lower rail segments 130. The top coupler 163 or 181 is matingly received into open end of support member 221, and preferably bolted or otherwise rigidly and removably secured to the support member 221 of each of its two adjacent upper rail segments 210.

A clip 231 may be attached to the outwardly angled end 213 of the lip 212 of two adjacent upper frame members 210. The clip 231 could be screwed, bolted or otherwise rigidly and removably secured to two adjacent upper frame members 210. Clip 231 causes the vertical lip 212 of two adjacent upper frame members 210 to act as a single rigid member. As discussed above, the top coupler 163 of post 160 is bolted or otherwise rigidly secured to the support 221 of each of its adjacent upper frame members 210. Adjacent upper frame members 210 act as single integral members. The clips 231 help resist horizontal forces, such as wind loads, acting on the frame sections 102–105 that might otherwise cause one or more of those sections to bend inwardly towards or outwardly from the equipment 20.

The upper frame members 210 in a common frame section 102, 103, 104 or 105 combine to form a top rail 249 for that section. The top rail 249 of a longitudinal section 102 and 103 has a length. The top rail 249 of a lateral section 104 and 105 has a length. As each frame segment 110 contains one lower rail segment 130 and one upper rail segment 210, there are the same number of upper and lower segments in each longitudinal section 102 and 103, and the same number of upper and lower segments in the lateral 104 and 105 sections. The length of the top rail 249 is substantially equal to the length of the bottom rail 149 in the same section. Similar to the bottom rail 149, the length of the top rail 249 is roughly equal to sum of the number N of upper rail segments 130 in that section. The length of the top rail 249 in the longitudinal sections 102 and 103 is roughly equal to the length L(f) of the framework 100, and the length of the top rail in the lateral sections 104 and 105 is roughly equal to the width W(f) of the framework.

The top and bottom rails 149 and 249 in the same section 102–105 are parallel, and have the same length. The top and bottom rails 149 and 249 of the longitudinal sections 102 and 103 are parallel to and roughly equal in length to the channels 75 and 76 forming the longitudinal set of channels 71. The top and bottom rails 149 and 249 of the lateral sections 104 and 105 are parallel to and roughly equal in length to the channels 77 and 78 forming the lateral set of channels 72.

The framework 100 of the screening assembly 50 forms a truss structure that helps reduce the necessary gauge thickness or weight of the members forming the framework and improves its load carrying capacity. When certain loads are placed on the lower rail 149, a portion of the load is transferred via the posts 150 to the upper rail 249. Both the bottom and top rails 149 and 249 are load-carrying members. Sharing the load between the upper and lower rails 149 and 249 increases the strength or load carrying capacity of the framework 100 and overall assembly 50.

The panels 300 are shown in FIGS. 3, 5, 7, 10 and 14. Each panel 300 has the same rectangular shape and dimensions. Each like-shaped panel 300 has a frame that includes a top 301, a bottom 302 and opposed sides 303 and 304. The panel frame can include a rear panel 305. The distance between the top and bottom portions 301 and 302 define the height of the panel 300. The distance between the side portions 303 and 304 define the length of the panel 300. The thickness of the panel portions 301–304 is slightly less than the width of the panel platform 131 and panel catch 211. The panels 300 can have a solid front face 310 or include louvers 315 that span its length.

Figure 14:
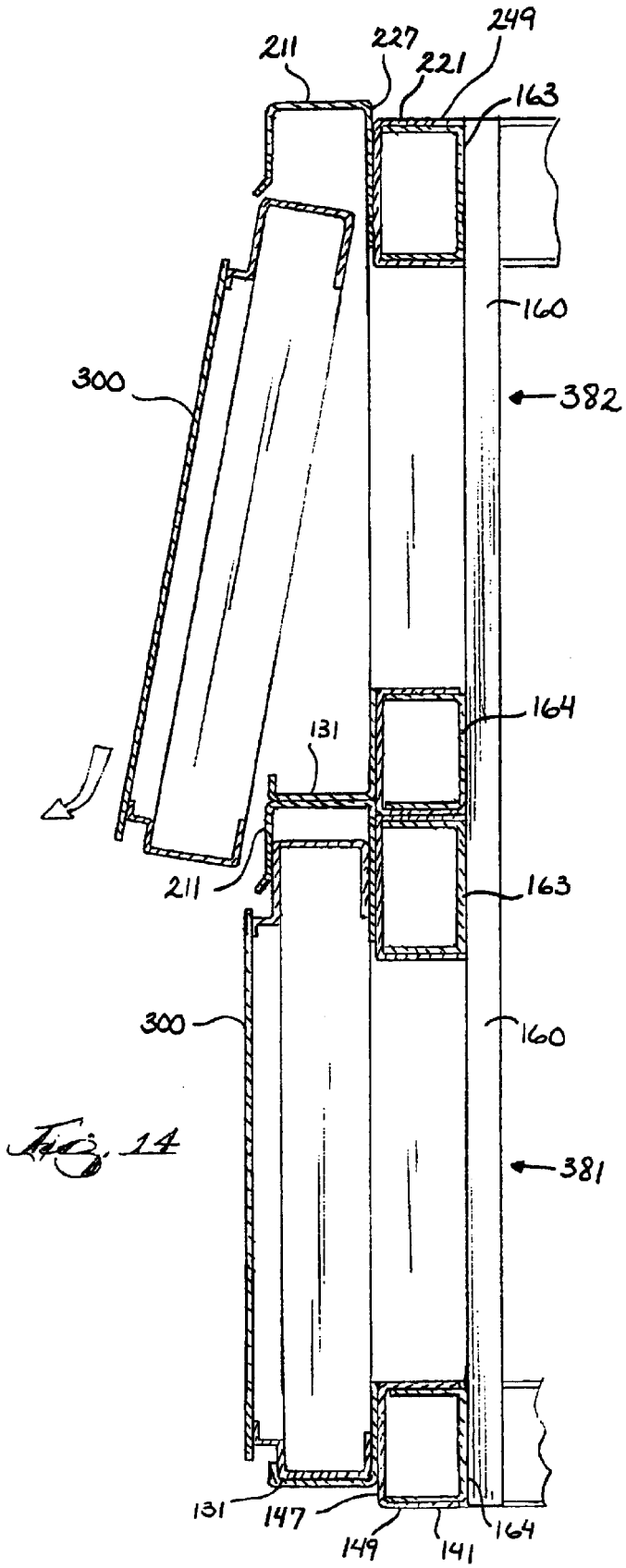
FIG. 14 is a sectional view of the present roof screening assembly invention with a multi-tiered framework that includes a first lower tier and a second upper tier.

One like-shaped panel 300 is slidingly received into and supported by each frame segment 110. To insert a panel 300 into its frame segment 110, the top frame portion 301 of the panel 300 is inserted into the panel catch 211 of the upper frame member 210. The panel 300 is pushed far enough up in the catch 211 that the top portion 301 abuts or almost abuts the top web 214 of the panel catch 211. The bottom frame portion 302 now clears the tip or uppermost end of the lower lip 132 of the panel platform 131. The bottom portion 302 is then pushed or rotated towards the framework 100 until the bottom portion is directly over the panel platform 131. The panel 300 is then lowered or allowed to drop down between the lower lip 132 and flange 135 until it rests on the lower horizontal web 134 of the platform 131 as shown in FIG. 7. As stated above, the height of the upper lip 212 is greater than the height of the lower lip 132. This height differential allows the top frame portion 301 to remain engaged by the upper lip 212 when the panel 300 is resting on the panel platform 131. The panel 300 is removed in a reverse manner, as shown in FIG. 14. An anti-rattle screw 406 is used to help prevent rattling or movement of the panels 300. The screw 406 attaches the vertical lip 212 of an upper frame member 210 to the top frame portion 301 of the panel 300. A rubber grommet 407 is placed on the lower web 134 of panel platform 131 to reduce vibrations, and prevents the panels 300 from scratching the lower frame members 130.

An alternate embodiment of the present invention utilizes a modified version of the frame segments 110. Two like-shaped, inwardly facing, U-shaped channels form the opposed sides of each frame segment. These two channels combine with the panel platform 131 to hold the panel 300 in place. The upper frame member 210 and its panel catch 211 are not needed. The panel 300 is inserted into its frame segment by sliding it down between the U-shaped channel until it rests on its panel platform 131.

Figure 5:
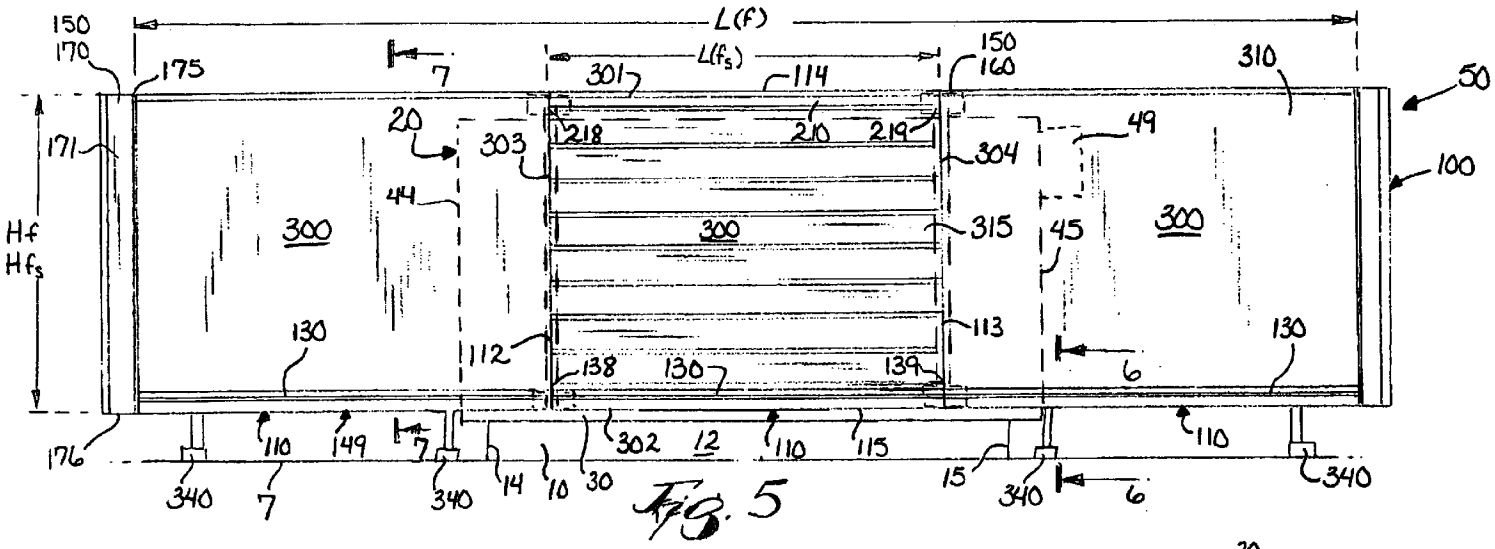
FIG. 5 is a front view of the present roof screening assembly.

Channel supports 340 can be used to provide added support near the ends 66 and 67 of the channels 60 as shown in FIGS. 5 and 6. The support 340 can be used when one or more sections 102–105 of the framework 100 is cantilevered or spaced several feet from the equipment base 30. The support post 340 has a top end that is rigidly clamped or otherwise connected to the channel 60, and a bottom end that is connected to a footer 345. The footer 345 rests on the surface 7 of the roof 5, and has a large surface area that distributes its load over a relatively large area of the surface 7 of the roof 5.

The screening assembly 50 can produce a multi-tiered framework 380 as shown in FIG. 14. The multi-tiered framework 380 includes a first or lower tier 381 and a second or upper tier 382. Although only one upper tier 382 is shown and described, it should be understood that additional tiers could be added in stacked relation atop the second tier 382 without departing from the broad aspects of the invention. The upper tier 382 is constructed directly on top of the lower tier 381. Each tier 381 and 382 has a similarly constructed framework 100 with corresponding sections 102–105. Each corresponding section 102, 103, 104 or 105 of the upper tier 382 is stacked atop a corresponding section in the lower tier 381 so that the two stacked sections are in parallel alignment and their ends 108 and 109 are in linear alignment. Similarly, each frame segment 110 of the upper tier 382 is stacked atop its corresponding frame segment 110 in the lower tier 381 so that the two segments are in parallel alignment and their side ends 112 and 113 and posts 150 are in linear alignment. Each section 102–105 of the upper tier 382 has bottom and top rails 149 and 249. The bottom rail 149 of each section in the upper tier 382 is flushly aligned with and bolted or otherwise rigidly secured to the top rail 249 of its corresponding section of the lower tier 381.

The offsets 147 in the segments 130 forming the bottom rail 147 abut the offsets 227 in the segments 210 forming the top rail 227. The offsets 147 and 227 in each corresponding section 102, 103, 104 or 105 extend linearly from one end of the section to the other. The offsets 147 and 227 provide a mechanism for aligning the corresponding sections of the upper and lower tiers 381 and 382 into parallel alignment. The offsets 147 and 227 also provide a mechanism for securing each section 102, 103, 104 or 105 of the upper tier 382 atop its corresponding lower tier 381. The offsets 147 and 227 help prevent the section 102, 103, 104 or 105 of the upper tier 382 from sliding horizontally relative to its corresponding section in the lower tier 381. The offsets 147 and 227 in stacked section 102, 103, 104 or 105 prevent the upper section from sliding in a direction perpendicular to its corresponding lower section. The offsets 147 and 227 in different stacked sections, prevent movement in different directions. The offsets 147 and 227 in the four corresponding sections 102–105 combine to form a mechanism that locks or otherwise helps prevent horizontal movement of the upper tier 381 in any direction relative to the lower tier 381.

The broad aspect of the present screening assembly 50 contemplates situations where screening is not needed or desired to extend completely around the equipment 20. For example, in FIG. 15, the screening assembly 50 only extends around three sides of the equipment 21 located near an elevator room 29. When one of the sections 102–105 of the framework 100 is eliminated, the set 71 or 72 of channels 60 that would have supported that section need not extend beyond the base 30 of the equipment 20 in the direction of the eliminated section. One set of common ends 66 or 67 is eliminated.

Figure 15:
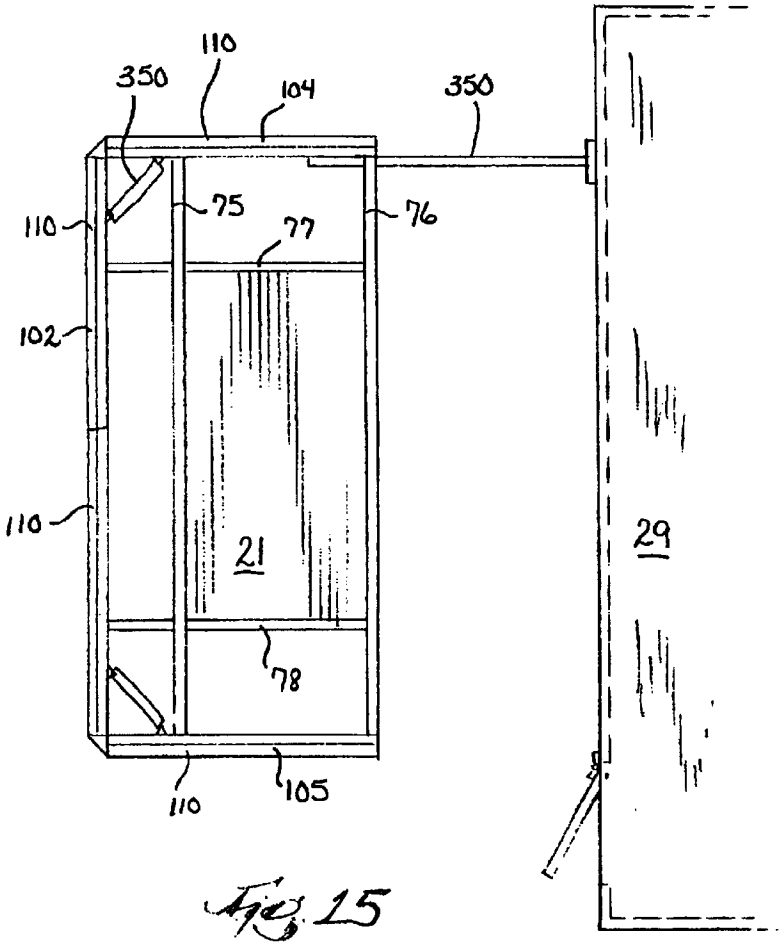
FIG. 15 is a top view of the present roof screening assembly invention with a framework formed by three section to accommodate an elevator building and with gussets that provide additional strength to the assembly.
Figure 10:
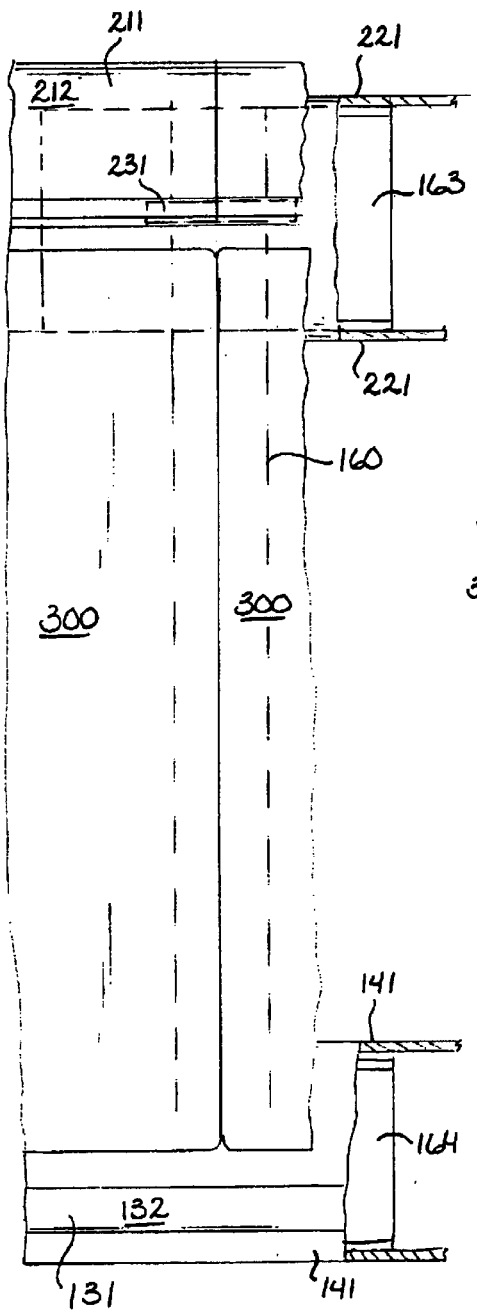
FIG. 10 is a front view the panel secured to the frame segment having the lower and upper frame rail segments and the intermediate post.

Gussets 350 can be used to help stabilize the framework 100, particularly when the framework 100 does not completely surround the equipment 20 as in FIG. 15. Each gusset 350 has a middle portion and opposed ends. A gusset coupler 355 is pivotally secured to each end of the gusset 350. Each coupler 355 has a U-shape similar to couplers 163 and 164 of posts 160. The couplers 355 are secured near the corner posts 170 of adjacent bottom rails 149 or adjacent top rails 249. The gusset 350 can also be connected to the end of a bottom or top rail 149 or 249. One coupler is pivotally secured to the end of the rail and the other coupler is secured to a nearby wall or structurally solid surface.

The modularity of the support assembly 55, framework 100 and panels 300 give the screening assembly 50 a degree of adaptability that allows it to screen a wide range of equipment 21–25 as shown in FIG. 1. Each section 102–105 of the framework 100 is formed of one or more like-shaped segments 110. Each section 102–105 has a length equal to a multiple of the length of the segment 110. Each set 71 and 72 of channels 60 and its corresponding bottom and top rails 149 and 249 have a length roughly equal to a multiple of the length of the frame segment 110. Thus, the common ends 66 and 67 of the channels 60 can extend a wide range of distances from the base 30 of the equipment 20. In addition, the screen assembly 50 can screen around all the sides 42–45 of the equipment 20, or just two or three adjacent sides.

Although the construction or process of assembling of the modular roof screening assembly 50 should be apparent from the above description, the following is provided for the benefit of the reader. First, the equipment 20 and number of sides 42–45 of the equipment to be screened are determined. The desired amount of clearance or spacing between the framework 100 and the walls 42–45 of the housing is determined to obtain the desired amount of access to repair and maintain the equipment. The proper length L(c1) and L(c2) of the respective channel sets 71 and 72 is then determined. The horizontal channels 60 are cut to the desired length and bolted or otherwise rigidly connected to the base 30. Frame segments 110 are then formed and interconnected to make the individual sections 102–105 of the framework 100. The sections 102–105 are then connected to their respective common ends 66 or 67 of channels 60. The sections 102–105 are then joined together to form the completed framework 100.

Figure 16:
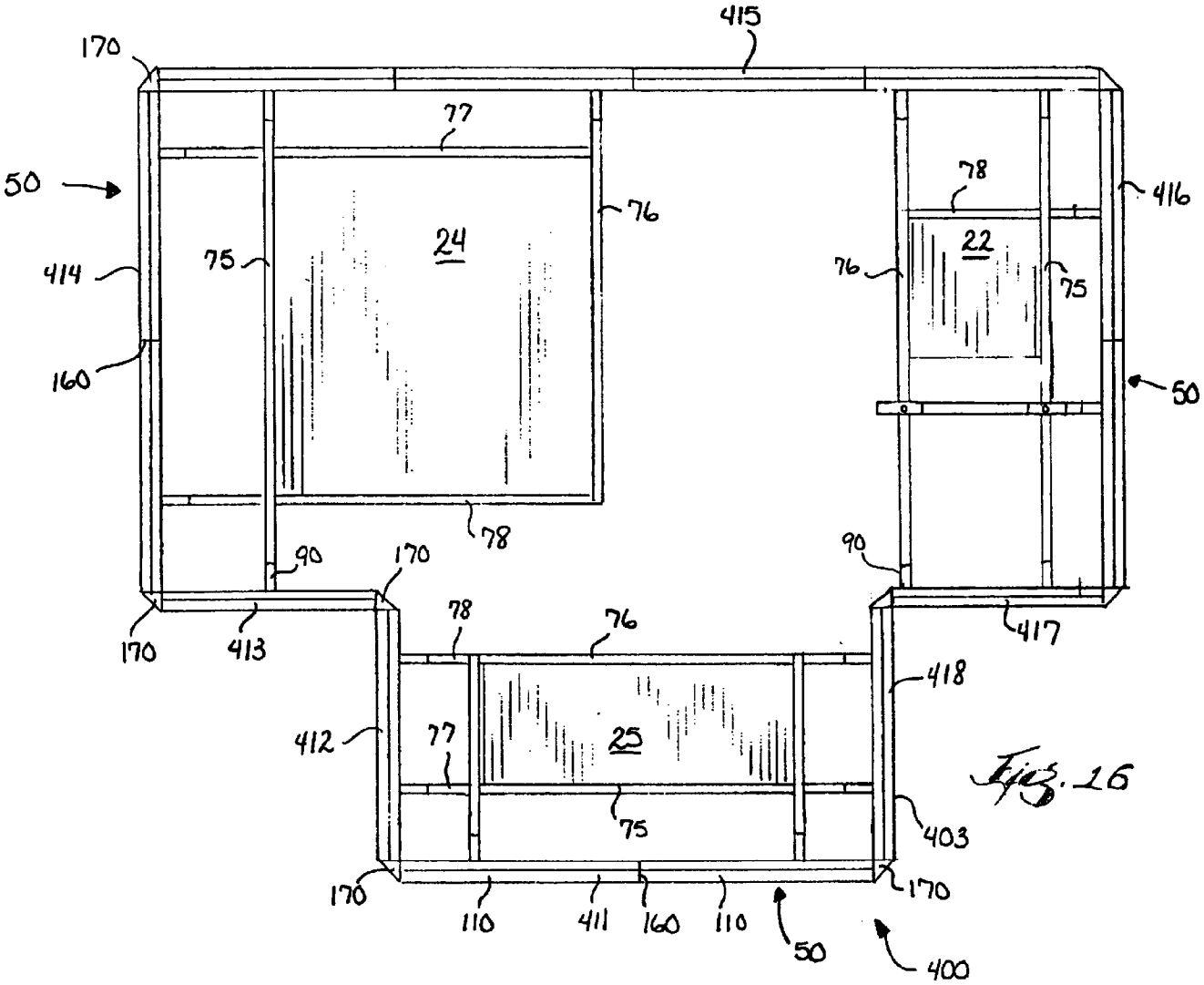
FIG. 16 is a top view of the present screening assembly invention in the form of an integrated screening assembly with sets of channels attached to each of several pieces of equipment and with the framework including sections and panels that screen around each of the pieces of equipment.

Multiple pieces of equipment 20 are frequently located in one or more clusters 28 on a roof 5. The present screening assembly 50 can be combined with other assemblies to form a single integrated screening assembly 400 to screen around a cluster 28 of equipment 20 as in FIG. 16. First, the desired perimeter 403 of the screen assembly 400 around the cluster 28 is determined. The perimeter 403 does not need to be square or rectangular. The perimeter 403 can take on a variety of shapes with linear sections 411–418. Adjacent sections are preferably aligned at right angles. The desired length of each section 411–418 is determined. Each section 411–418 is a multiple of the length of the frame segment 110. Each section 411–418 either shares a common corner post 170 with each of its adjacent sections, or has an end that abuts the end of its adjacent section. The lengths of the sets 71 and 72 of channels 60 for each piece of equipment 20 are determined, and the channels 60 are cut. The sets 71 and 72 of channels 60 are rigidly secured to their appropriate sides 32 and 33 or 34 and 35 of the base 30 of their intended piece of equipment 20. The channels 60 are positioned on the base 30 so that their common ends 66 and 67 are substantially aligned or registered with their intended common linear portion of the perimeter 403. The various sections 411–418 of the framework 100 are assembled and connected to their associated common ends 66 or 67. The ends 108 and 109 of adjacent sections 411–418 either share a common corner post such as post 170, or are fastened or otherwise secured to each other.

Each section 411–418 is secured to the assembly 400 at two or more points. Two points of securement are formed by joining the ends 108 and 109 of each section 411–418 to its two adjacent sections. Two additional points of securement are typically formed by the two common ends 66 or 67 of the channels 60 that connect to and support a given section 411–418. Larger sections that span across two pieces of equipment, such as section 415, are supported by four common ends 66 or 67. Shorter sections that do not extend beyond both sides 32 and 33 or 34 and 35 of their associated piece of equipment 20, such as section 413, are only supported by one channel end 66 or 67. Channel supports 340 may also be used to help support one or more sections 411–418 of the assembly 400 if the channel ends 66 or 67 extend a large distance beyond the base 30 of the equipment 20.

While the invention has been described with reference to a few preferred embodiments, it will be understood by those skilled in the art that various changes may be made and equivalents may be substituted without departing from the broad aspects of the invention.

What is claimed is:

1. A modular roof equipment screening assembly for screening a piece of equipment on a roof of a building, the equipment having an equipment base and an equipment housing, the roof having an equipment curb adapted to supportably engage the equipment base, the equipment base having opposed sets of longitudinal and lateral sides, the equipment curb having corresponding opposed longitudinal and lateral sides, and the equipment housing having opposed longitudinal and lateral housing faces, the housing faces extending substantially vertically from the base and forming a perimeter of the equipment, said modular roof equipment screening assembly comprising:

a cantilevered, multi-directional support assembly rigidly secured to one of either the equipment base and the equipment curb, said support assembly including first and second sets of mounting channels, each of said channels having a mid section and opposed ends, said mid section of each of said channels being rigidly secured to one of either the equipment base and the equipment curb, said channels in said first set being directly secured to the opposed longitudinal sides of one of either the equipment base and the equipment curb, and said channels in said second set being directly secured to one of either said first set of channels and the opposed lateral sides of one of either the equipment base and the equipment curb, each of said sets of said channels having at least one set of common ends, said set of common ends of said first set of channels extending a predetermined distance beyond a first lateral housing face, and said set of common ends of said second set of channels extending a predetermined distance beyond a first longitudinal housing face;

a framework having a lower portion secured to and supported by said support assembly, said framework being secured to and extending substantially vertically upwardly from said channel ends and extending around a plurality of the housing faces, said framework including at least one longitudinal section aligned substantially parallel to one of said longitudinal housing faces, and at least one lateral section aligned substantially parallel to one of said lateral housing faces, said framework being formed by a plurality of like-shaped frame segments having a predetermined segment length dimension, each frame section including at least one frame segment, each frame section being secured to one of said sets of common ends of said support assembly, and each of said sections being spaced a substantially constant distance from its respective first housing face to provide a substantially constant working space between that said section and its respective first housing face; and, a plurality of like-shaped panels, each of said like-shaped panels being substantially vertically aligned and supported by one of said like-shaped frame segments.

2. The modular roof equipment screening assembly of claim 1, and wherein each of said sets of said channels has a second opposed set of common ends, said second opposed set of common ends of said first set of channels extending a predetermined distance beyond a second opposed lateral housing face, and said second opposed set of common ends of said second opposed set of channels extending a predetermined distance beyond a second opposed longitudinal housing face; and, wherein said framework is secured to each of said sets of common ends, said framework including a second opposed longitudinal section aligned substantially planar to the second opposed longitudinal housing face, and a second opposed lateral section aligned substantially planar to the second opposed lateral housing faces, and each section of said frame being secured to one of said sets of common ends of said support assembly.

3. The modular roof equipment screening assembly of claim 2, and wherein said substantially constant distances of said sections from the housing faces are different for at least two of said sections.

4. The modular roof equipment screening assembly of claim 2, and wherein said framework and panels extend around the entire perimeter of the equipment.

5. The modular roof equipment screening assembly of claim 2, and wherein each like-shaped frame segment has a like-shaped lower frame member, a pair of opposed upwardly extending posts, and a like-shaped upper frame member.

6. The modular roof equipment screening assembly of claim 5, and wherein adjacent frame segments share a common post.

7. The modular roof equipment screening assembly of claim 6, and wherein at least one of said sections of said framework is formed by at least two adjacent substantially planar like-shaped frame segments.

8. The modular roof equipment screening assembly of claim 2, and wherein the opposed longitudinal sides of the equipment base are substantially parallel to each other, the opposed longitudinal sides of the equipment curb and the opposed longitudinal housing faces, and the opposed lateral sides of the equipment base are substantially parallel to each other, the opposed lateral sides of the equipment curb and the opposed lateral housing faces, and each of said channels in said first set of channels has a first substantially equal length dimension, and each of said channels in said second set of channels has a second substantially equal length dimension.

9. The modular roof equipment screening assembly of claim 8, and wherein the equipment has predetermined length and width dimensions and a substantially rectangular shape.

10. The modular roof equipment screening assembly of claim 8, and wherein each of said channels has a length dimension substantially equal to a multiple of said predetermined segment length dimension.

11. The modular roof equipment screening assembly of claim 8, and wherein each of said channels is substantially linear in shape.

12. The modular roof equipment screening assembly of claim 11, and wherein each of said channels in said first set has a substantially parallel alignment with said other channel in said first set, and each of said channels in said second set has a substantially parallel alignment with said other channel in said second set.

13. The modular roof equipment screening assembly of claim 12, and wherein each of said channels in said first set have a substantially planar alignment with each of said channels in said second set.

14. The modular roof equipment screening assembly of claim 12, and wherein each section of said framework includes a bottom rail, and said lower portion of said framework is formed by said bottom rails.

15. The modular roof equipment screening assembly of claim 12, and wherein each of said bottom rails is formed by a plurality of like-shaped lower frame members.

16. The modular roof equipment screening assembly of claim 5, and wherein said lower frame members in each section form a bottom rail, said upper frame members in each section form a top rail, and said bottom rail, top rail and posts in each section form a truss.

17. The modular roof equipment screening assembly of claim 5, and wherein said framework has first and second tiers, said first tier being formed by said sections secured to said sets of common ends of said support assembly, each of said sections in said first tier having a bottom rail formed by said lower frame members and an upper rail formed by said upper frame members, said second tier being formed by additional sections having a bottom rail formed by additional lower frame members and an upper rail formed by additional upper frame members, each of said sections in said upper tier being stacked directly atop and in substantially planar alignment with its corresponding section in said first tier, said lower rail of each of said sections in said second tier being rigidly secured to said upper rail of its said corresponding section in said first tier.

18. A roof equipment screening assembly for integrally screening at least a first and a second piece of equipment on a roof of a building, each of the pieces of equipment having an equipment base and an equipment housing, the roof having a first and second equipment curbs, each curb being adapted to supportably engage the equipment bases of one of the pieces of equipment, each of the equipment bases having opposed longitudinal and lateral sides, each of the equipment curbs having corresponding opposed longitudinal and lateral sides, and each of the equipment housings having opposed longitudinal and lateral housing faces, said roof equipment screening assembly comprising:

a first cantilevered, multi-directional support assembly rigidly secured to one of either the equipment base and the equipment curb of the first piece of equipment, said support assembly including first and second sets of mounting channels, each of said channels having a mid section and opposed ends, said mid section of each of said channels being rigidly secured to one of either the equipment base and the equipment curb of the first piece of equipment, said channels in said first set being directly secured to the opposed longitudinal sides of one of either the equipment base and the equipment curb of the first piece of equipment, and said channels in said second set being directly secured to one of either said first set of channels and the opposed lateral sides of one of either the equipment base and the equipment curb of the first piece of equipment, each of said sets of said channels having at least one set of common ends, said set of common ends of said first set of channels extending a predetermined distance beyond a first lateral housing face of the first piece of equipment, and said set of common ends of said second set of channels extending a predetermined distance beyond a first longitudinal housing face of the first piece of equipment;

a second cantilevered, multi-directional support assembly rigidly secured to one of either the equipment base and the equipment curb of the second piece of equipment, said support assembly including third and fourth sets of mounting channels, each of said channels having a mid section and opposed ends, said mid section of each of said channels being rigidly secured to one of the sides of one of either the equipment base and the equipment curb of the second piece of equipment, said channels in said third set being secured to the opposed longitudinal sides of one of either the equipment base and the equipment curb of the second piece of equipment, and said channels in said fourth set being secured to the opposed lateral sides of one of either the equipment base and the equipment curb of the second piece of equipment, each of said third and fourth sets of said channels having at least one set of common ends, said set of common ends of said third set of channels extending a predetermined distance beyond a second lateral housing face of the second piece of equipment, and said set of common ends of said fourth set of channels extending a predetermined distance beyond a second longitudinal housing face of the second piece of equipment;

a unitary framework having a lower portion secured to and supported by said support assemblies, said framework being secured to and extending upwardly from said channel ends of said support assemblies, said framework including at least one longitudinal section aligned with one of said longitudinal housing faces, and at least one lateral section aligned with one of said lateral housing faces, each frame section being joined to one of said sets of common ends of one of said support assemblies, and one section of said framework secured to one of said sets of common ends of said first support assembly joining one section of said framework secured to one set of common ends said second support assembly.

19. The roof equipment screening assembly of claim 18, and further including a plurality of panels, each of said panels being supported by said framework.

20. The roof equipment screening assembly of claim 19, and wherein said framework includes a plurality of like-shaped frame segments having a predetermined segment length dimension, each frame section including at least one frame segment, and each of said panels is a like-shaped panel.

21. The roof equipment screening assembly of claim 19, and wherein each of the housing faces extends substantially vertically from the base of one of either the first and second pieces of equipment and said framework extending substantially vertically upward from said support assemblies.

22. The roof equipment screening assembly of claim 21, and wherein each of said sections of said framework is substantially parallel to and spaced a substantially constant distance from one of said housing face of its said piece of equipment to provide a substantially constant working space between each of said sections and its respective housing face.

* * * * *